US008631521B1

(12) United States Patent
Baker

(10) Patent No.: US 8,631,521 B1
(45) Date of Patent: Jan. 21, 2014

(54) TOILET SEAT HINGE

(76) Inventor: Theodore W. Baker, Independence, OR (US)

( * ) Notice: Subject to any disclaimer, the term of this patent is extended or adjusted under 35 U.S.C. 154(b) by 915 days.

(21) Appl. No.: 12/688,899

(22) Filed: Jan. 17, 2010

Related U.S. Application Data

(63) Continuation-in-part of application No. 11/206,501, filed on Aug. 19, 2005, now Pat. No. 7,647,652.

(60) Provisional application No. 60/603,458, filed on Aug. 21, 2004.

(51) Int. Cl.
*A47K 13/12* (2006.01)

(52) U.S. Cl.
USPC ..... 4/236

(58) Field of Classification Search
USPC ..... 4/236, 234
See application file for complete search history.

(56) References Cited

U.S. PATENT DOCUMENTS

| | | | | |
|---|---|---|---|---|
| 3,550,164 | A | 4/1968 | Pease | |
| 3,802,000 | A | 4/1974 | Waldon | |
| 3,820,175 | A | 6/1974 | Waldon | |
| 3,916,459 | A | 11/1975 | Ivancevic | |
| 4,197,596 | A | 4/1980 | Fantetti | |
| 4,342,124 | A | 8/1982 | Paredes | |
| 4,367,567 | A | 1/1983 | Sendoykas | |
| 4,438,535 | A * | 3/1984 | Paredes | 4/234 |
| 4,680,816 | A * | 7/1987 | Colombani | 4/240 |
| 4,939,796 | A | 7/1990 | Pepper | |
| 4,965,889 | A * | 10/1990 | Tissot et al. | 4/234 |
| 4,965,890 | A | 10/1990 | Fischer | |
| 4,970,731 | A | 11/1990 | Fait | |
| 5,175,891 | A | 1/1993 | Ohshima et al. | |
| 5,251,338 | A | 10/1993 | Light | |
| 5,279,000 | A | 1/1994 | Mercier et al. | |
| 5,448,781 | A | 9/1995 | Miller | |
| 5,724,683 | A | 3/1998 | Sorimachi et al. | |
| 5,906,010 | A | 5/1999 | Suzuki | |
| 5,918,322 | A | 7/1999 | Yamamoto et al. | |
| 5,937,448 | A | 8/1999 | Brill et al. | |
| 6,052,869 | A | 4/2000 | Suzuki | |
| 6,085,360 | A | 7/2000 | Yoke et al. | |
| 6,178,597 | B1 | 1/2001 | Suzuki et al. | |
| 6,243,884 | B1 | 6/2001 | Simonson | |
| 6,275,999 | B1 | 8/2001 | Fujita | |

(Continued)

OTHER PUBLICATIONS

Office Action Dated May 28, 2008 for U.S. Appl. No. 11/206,501 (10 pages).

(Continued)

*Primary Examiner* — Huyen Le

(57) ABSTRACT

A toilet seat hinge and a toilet seat assembly including the toilet seat hinge are disclosed. The disclosed toilet seat hinge can be configured to reduce or eliminate gaps, edges, sharp corners, and/or exposed surfaces found in and around conventional toilet seat hinges. This can be done, for example, without compromising simplicity or manufacturability. Several features of the disclosed toilet seat assembly make it easier to clean than conventional toilet seat assemblies. The seat and lid, for example, can be attached to rotatable elements that are cradled in a base and rotate on substantially the same axis. The profile of the hinge can be streamlined with numerous concave surfaces. Portions of the seat and lid that are not connected to one of the rotatable elements can, for example, slide against other elements so as not to create gaps or sharp corners.

23 Claims, 20 Drawing Sheets

(56) References Cited

U.S. PATENT DOCUMENTS

| | | | |
|---|---|---|---|
| 6,308,346 | B1 | 10/2001 | Brill et al. |
| 6,339,851 | B1 | 1/2002 | Bergkvist |
| 6,381,762 | B1 | 5/2002 | Moser |
| 6,389,611 | B2 | 5/2002 | Fujita |
| 6,421,842 | B1 | 7/2002 | Fujita |
| 6,449,780 | B1 | 9/2002 | Merry |
| 6,757,917 | B2 | 7/2004 | Kamysz et al. |
| 7,647,652 | B1 * | 1/2010 | Baker ..... 4/236 |
| 2003/0196297 | A1 | 10/2003 | Gerali et al. |
| 2004/0000029 | A1 | 1/2004 | Miller |
| 2009/0106884 | A1 | 4/2009 | Bemis et al. |

OTHER PUBLICATIONS

Office Action Dated Jun. 10, 2009 for U.S. Appl. No. 11/206,501 (8 pages).

* cited by examiner

TOILET SEAT HINGE

CROSS REFERENCE TO RELATED APPLICATIONS

This is a continuation-in-part of prior U.S. patent application Ser. No. 11/206,501, filed Aug. 19, 2005, now issued as U.S. Pat. No. 7,647,652, which claims the benefit of prior U.S. Provisional Patent Application No. 60/603,458, filed Aug. 21, 2004. Both prior applications are incorporated herein by reference.

FIELD

This disclosure concerns toilet seat hinges and toilet seat assemblies incorporating these hinges.

BACKGROUND

Most conventional toilet seat assemblies include a seat and a lid. The seat and the lid typically are connected to a toilet body by two hinged brackets. Each hinged bracket has a hole that lines up with a mounting hole on the toilet body. To secure the toilet seat assembly to the toilet body, bolts are strung through the brackets and the underlying mounting holes. These bolts are held in place by nuts. The bolt heads often are covered with caps for aesthetic purposes.

Conventional toilet seat assemblies can be difficult to clean. This is at least partially due to gaps created in and around the hinge area. For example, a large gap often is created between the brackets and below the back portion of the seat. Another gap often is created between the back portion of the seat and the back portion of the lid. Other gaps can be created within and around the hinge area when the seat or lid is moved.

In addition to gaps, conventional toilet seat assemblies, when installed, typically create sharp corners and edges, which also are difficult to clean. For example, the moving parts of the hinge area typically separate and create sharp corners when the seat or lid is moved. Other sharp corners can be created around the hinge area where it meets the mounting surface. In addition, the middle portions of the back sides of the seat and lid typically are exposed and difficult to access.

Toilet seat assemblies, particularly in hotels and public restrooms, require regular cleaning. Gaps, edges, sharp corners, and numerous exposed surfaces make it difficult to adequately clean the hinge areas of conventional toilet seat assemblies. Simply wiping the hinge area with a rag or paper towel usually is not sufficient. In fact, most common cleaning techniques are ill suited for penetrating gaps and conforming to sharp corners.

There is a need for toilet seat hinges that are easier to clean, such as toilet seat hinges that have fewer gaps, edges, sharp corners, and/or exposed surfaces when incorporated into toilet seat assemblies and installed on toilet bodies.

SUMMARY

Disclosed herein are embodiments of a toilet seat assembly and embodiments of a hinge for use in a toilet seat assembly. In some disclosed embodiments, the toilet seat assembly includes a hinge configured to connect at least a seat (e.g., a seat only or a seat and a lid) to a toilet body and to allow for the independent movement of the seat and/or lid between a closed position and an open position. The toilet body can, for example, have a substantially flat mounting surface with a first mounting hole and a second mounting hole. The hinge of embodiments of the disclosed toilet seat assembly can cover both the first mounting hole and the second mounting hole. The hinge also can be configured, for example, to substantially cover a portion of the mounting surface along a substantially continuous path extending from the first mounting hole to the second mounting hole. The path can be straight or curved. In some disclosed embodiments, there are substantially no exposed gaps between the hinge and the mounting surface of the toilet body between the first mounting hole and the second mounting hole when the hinge is mounted on the toilet body.

When installed on a toilet body, the hinge of embodiments of the disclosed toilet seat assembly can have a front surface and a back surface that abut the mounting surface at front and back surface junctions, respectively. One or more rotatable elements, when present, can rotate on an axis that is closer to the front surface junction than to the back surface junction. In some embodiments, the front and/or back surface junction is substantially or at least partially concave. Similarly, the hinge of some embodiments has side surfaces that abut the mounting surface at side surface junctions that can be substantially or at least partially concave.

The hinge of embodiments of the disclosed toilet seat assembly can include one or more fixed elements and one or more rotatable elements. If present, a first rotatable element can, for example, be attached to a seat. If present, a second rotatable element can, for example, be attached to a lid. When a seat and a lid are present, the seat can slidably abut a convex surface of a rotatable element attached to the lid and, similarly, the lid can slidably abut a convex surface of a rotatable element attached to the seat. One or both of the rotatable elements can be positioned directly adjacent to a fixed element. In some disclosed embodiments, there are substantially no exposed gaps between the first rotatable element and the fixed element as the seat is moved between a closed position and an open position. If both a seat and a lid a present, there can be substantially no exposed gaps between the first rotatable element and the fixed element, between the second rotatable element and the fixed element, and/or between the first rotatable element and the second rotatable element as the seat or the lid is moved between a closed position and an open position. There also can be substantially no exposed gaps between the one or more rotatable elements and the mounting surface of the toilet body when the toilet seat assembly is mounted on the toilet body.

The fixed element can be, for example, a tower positioned horizontally to the side (with or without intervening elements) of a rotatable element attached to a seat when the toilet seat assembly is mounted on a toilet body. The fixed element also can be, for example, a cradle positioned vertically below (with or without intervening elements) a rotatable element attached to a seat when the toilet seat assembly is mounted on a toilet body. The seat and/or lid can slidably abut the fixed element. For example, the seat and/or lid can slidably abut a convex surface of a fixed tower. The fixed element also can slidably abut a rotatable element. For example, a fixed cradle can slidably abut a convex surface of a rotatable element attached to the seat and/or a rotatable element attached to the lid.

In some disclosed embodiments, a base is configured to fixedly attach to the mounting surface of a toilet body, a first rotatable element is configured to attach to a seat, and a second rotatable element is configured to attach to a lid. The base can include a tower for holding the first and second rotatable elements in place. The base also can include a conformable pad positioned to be adjacent to the mounting surface when the hinge is installed on a toilet body. When assembled, the first and second rotatable elements can be configured to rotate on substantially the same axis, which can be curved or straight.

Some embodiments of the disclosed toilet seat assembly are designed to be manufactured in pieces. For example, some disclosed embodiments include a base configured to be manufactured as a first piece, a first rotatable element configured to be manufactured with a seat as a second piece, and a second rotatable element configured to be manufactured with a lid as a third piece. These pieces can be assembled alone or with other components to form a toilet seat assembly.

The seat and/or lid in embodiments of the disclosed toilet seat assembly can be connected to or slidably abut the hinge along substantially the entire length of a portion of the hinge. This portion of the hinge can be, for example, a portion extending between the first mounting hole and the second mounting hole on the mounting surface of a toilet body when the toilet seat assembly is mounted on the toilet body. The seat and/or lid each can have a back side with a middle portion. The middle portion of the back side of the seat and/or lid can extend between a first endpoint and a second endpoint and be bisected by an axis of symmetry of a toilet body when the toilet seat assembly is mounted on the toilet body. The first and second endpoints of the middle portions of the back sides of the seat and lid can be located, for example, where edge contours of the seat and lid turn away from the hinge. In some disclosed embodiments, there are substantially no exposed gaps (e.g., substantially no exposed gaps greater than about 1 millimeter) between the middle portion of the back side of the seat and the hinge as the seat is moved between a closed position and an open position. Similarly, in some disclosed embodiments, there are substantially no exposed gaps (e.g., substantially no exposed gaps greater than about 1 millimeter) between the middle portion of the back side of the lid and the hinge as the lid is moved between a closed position and an open position. Substantially the entire length of the middle portion of the back side of the seat and/or substantially the entire length of the middle portion of the back side of the lid, for example, can be either connected to or slidably abut the hinge. In some embodiments, the back side of the seat substantially abuts a rotatable element attached to the lid. Similarly, the back side of the lid can substantially abut a rotatable element attached to the seat.

The seat and lid can attach to the hinge at a seat attachment portion and a lid attachment portion, respectively. In some disclosed embodiments, the seat and lid attachment portions have top and bottom surfaces that are configured so as not to create sharp corners where they meet the hinge. The top and bottom surfaces, for example, can be at least partially concave. In some disclosed embodiments, at least two of the top surface of the seat attachment portion, the bottom surface of the seat attachment portion, the top surface of the lid attachment portion, and the bottom surface of the lid attachment portion are at least partially concave. In some disclosed embodiments, a top surface of the seat adjacent to the hinge and a bottom surface of the lid adjacent to the hinge or the top surface of the seat adjacent to the hinge, the bottom surface of the lid adjacent to the hinge, and a surface of the hinge together form an elongated, substantially concave surface when the seat and the lid are in the closed position. This elongated, substantially concave surface can be bisected by an axis of symmetry of a toilet body when the toilet seat assembly is mounted on the toilet body.

A top surface of the seat adjacent to the hinge and a surface of the hinge together can form a first elongated, substantially concave surface bisected by an axis of symmetry of a toilet body when the toilet seat assembly is mounted on the toilet body. Similarly, a bottom surface of the lid adjacent to the hinge and a surface of the hinge together can form a second elongated, substantially concave surface bisected by an axis of symmetry of a toilet body when the toilet seat assembly is mounted on the toilet body. There can be substantially no exposed gaps between the seat and the hinge along the first elongated, substantially concave surface as the seat is moved between the closed position and the open position. There also can be substantially no exposed gaps between the lid and the hinge along the second elongated, substantially concave surface as the lid is moved between the closed position and the open position. The hinge, the first elongated, substantially concave surface, and the second elongated, substantially concave surface each can have a length substantially parallel to a pivot axis of the seat and a pivot axis of the lid. The length of the first elongated, substantially concave surface can be equal to or greater than about one third of the length of the hinge. Similarly, the length of the second elongated, substantially concave surface can be equal to or greater than about one third of the length of the hinge. The lengths of the first and second elongated, substantially concave surfaces also can be equal to or greater than about half of the length of the hinge or about two thirds of the length of the hinge. There can be substantially no exposed gaps between the hinge and the mounting surface of the toilet body along length of the first elongated, substantially concave surface or the length of the second elongated, substantially concave surface when the toilet seat assembly is mounted on the toilet body.

One or more rotatable elements in the hinge of embodiments of the disclosed toilet seat assembly can have various exposed surfaces when the seat and lid are in different positions. In some disclosed embodiments, exposed surfaces of a rotatable element attached to a seat and a fixed element are substantially flush along substantially an entire seam between the rotatable element and the fixed element as the seat is moved between the closed position and the open position. Thus, no sharp corners are created between the rotatable element and the fixed element as the seat is moved between the closed position and the open position. A rotatable element attached to a lid can be similarly configured.

BRIEF DESCRIPTION OF DRAWINGS

FIG. 3B is an enlarged view of a section of the middle portion of the back side of the seat in the embodiment illustrated in FIGS. 1 and 2.

DETAILED DISCUSSION

Throughout this disclosure, the singular terms "a," "an," and "the" include plural referents unless the context clearly indicates otherwise. Similarly, the word "or" is intended to include "and" unless the context clearly indicates otherwise.

Disclosed herein are embodiments of a toilet seat assembly and embodiments of a toilet seat hinge for securing at least a seat to a toilet body, such as a standard toilet body. A standard toilet body typically includes a bowl and a tank. Between the bowl and the tank is a mounting surface penetrated by two mounting holes designed to receive bolts that can be used to secure a toilet seat assembly to the toilet body. The mounting holes can be positioned symmetrically near the rear of the bowl on side portions of the mounting surface with flat undersides. The center of the first mounting hole often is separated from the center of the second mounting hole by a distance of approximately 14 centimeters (5.5 inches). The spacing of the mounting holes is an industry standard and allows for broad compatibility between toilet seat assemblies and toilet bodies. Embodiments of the disclosed toilet seat assembly can be used with standard toilet bodies, including standard mounting hole configurations, or non-standard toilet bodies, including non-standard mounting hole configurations.

Figure 1A:
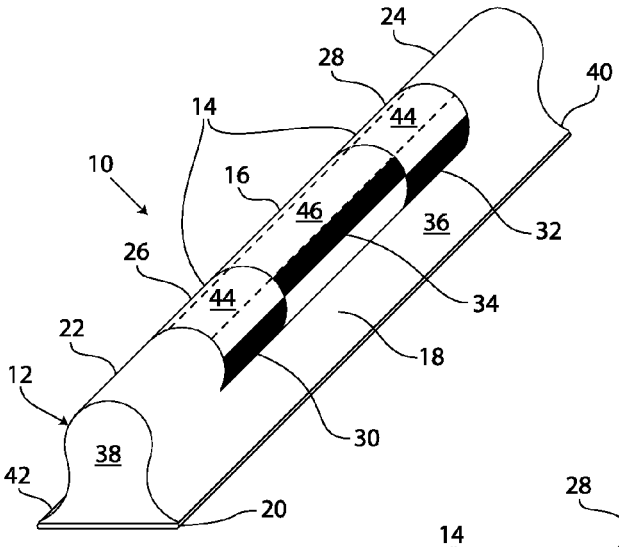
FIGS. 1A-1C are perspective views of the hinge of one embodiment of the disclosed toilet seat assembly, as viewed from the top and front.
Figure 1B:
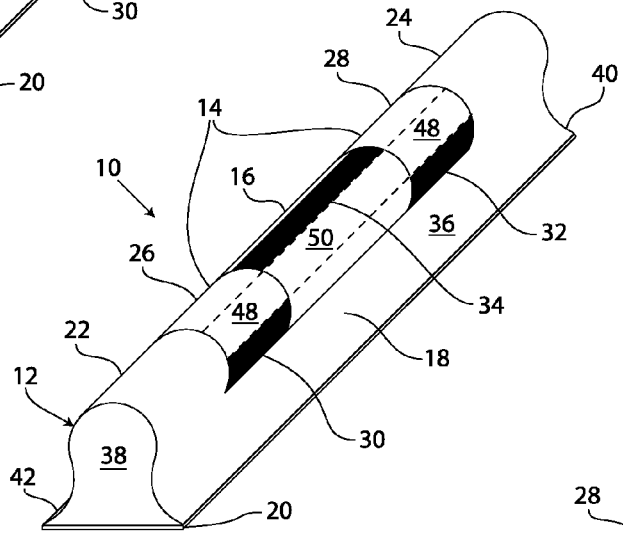
Figure 1C:
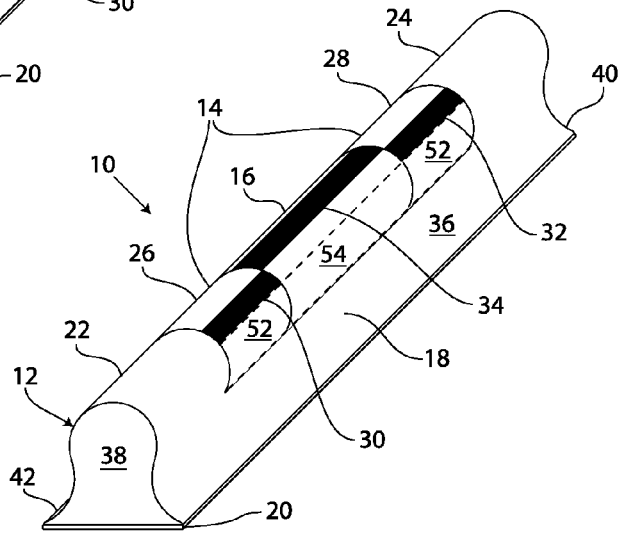

By way of introduction, FIGS. 1A-C illustrate the hinge of one embodiment of the disclosed toilet seat assembly. As with all of the embodiments discussed in this disclosure, the embodiment shown in FIGS. 1A-C is exemplary only and not intended to limit the scope of the overall disclosure. FIGS. 1A-C show a toilet seat hinge 10 including a base 12, a first rotatable element 14, and a second rotatable element 16. The base 12 includes a cradle 18, a pad 20, a first tower 22, and a second tower 24. The first rotatable element 14 includes a first section 26 and a second section 28. The second rotatable element 16 is positioned between the first section 26 and the second section 28. The first section 26 and the second section 28 are attached to a seat (not shown) at a first seat attachment area 30 and a second seat attachment area 32, respectively. Similarly, the second rotatable element 16 is attached to a lid (not shown) at a lid attachment area 34. The first rotatable element 14 and the second rotatable element 16 rotate on substantially the same axis and are supported on an axle (not shown). The axle passes through the first rotatable element 14 and the second rotatable element 16 and is supported on its ends by the first tower 22 and the second tower 24. The base 12, including the cradle 18, the pad 20, the first tower 22, and the second tower 24, is fixed when the toilet seat hinge 10 is installed on a toilet body.

The toilet seat hinge 10 has a front surface 36, two side surfaces 38, and a back surface (not shown). The front surface 36 has a front flared bottom portion 40. Similarly, the back surface has a back flared bottom portion 42. The front surface 36 and the back surface are concave as they extend toward the front flared bottom portion 38 and the back flared bottom portion 42, respectively.

FIGS. 1A-C illustrate the toilet seat hinge 10 with the seat and lid in various positions. Each figure has a continuous exposed portion surrounded by a dashed line. In FIG. 1A, the seat and lid are in a closed position. In this configuration, the first rotatable element 14 has an exposed back surface 44 and the second rotatable element 16 has an exposed back surface 46. In FIG. 1B, the seat is in the closed position and the lid is in the open position. In this configuration, the first rotatable element 14 has an exposed middle surface 48 and the second rotatable element 16 has an exposed middle surface 50. In FIG. 1C, the seat and lid are in the open position. In this configuration, the first rotatable element 14 has an exposed front surface 52 and the second rotatable element 16 has an exposed front surface 54.

The lid and seat, when present, slidably abut the first rotatable element 14 and the second rotatable element 16, respectively. The lid slidably abuts the first rotatable element 14 on the portions of the first rotatable element 14 directly adjacent to the sides of the lid attachment area 34. Similarly, the seat slidably abuts the second rotatable element 16 on the portion of the second rotatable element 16 directly between first seat attachment area 30 and the second seat attachment area 32.

Figure 2A:
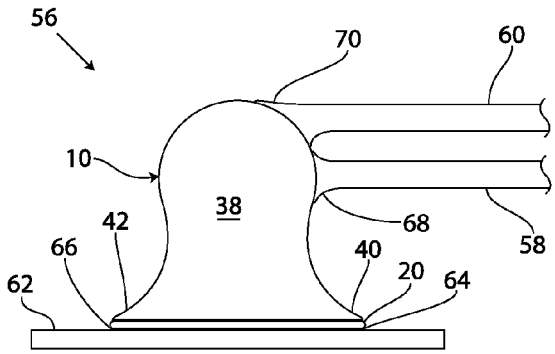
FIGS. 2A-2C are side profile views of the embodiment illustrated in FIG. 1, further including a seat and a lid, with the seat and lid truncated.
Figure 2B:
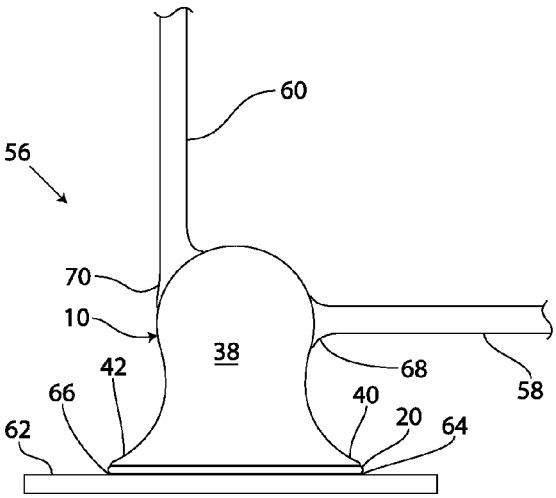
Figure 2C:
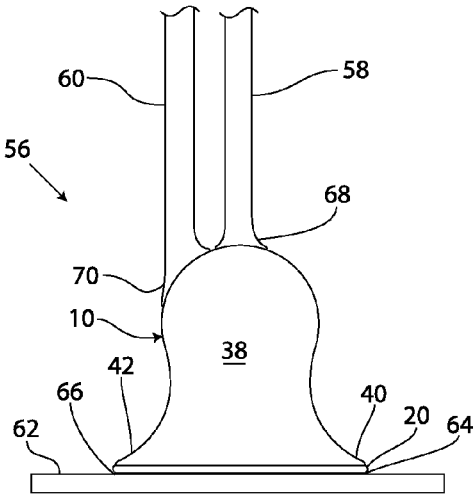

FIGS. 2A-C are side elevation views of a toilet seat assembly 56 including the toilet seat hinge 10 illustrated in FIGS. 1A-C along with a seat 58 and a lid 60. The reference numerals from FIGS. 1A-C are carried over to FIGS. 2A-C. In FIGS. 2A-C, the toilet seat hinge 10 is mounted on a mounting surface 62. The front flared bottom portion 40 and the back flared bottom portion 42 meet the mounting surface 62 at a front surface junction 64 and a back surface junction 66, respectively. The front flared bottom portion 40 and the back flared bottom portion 42 curve as they approach the mounting surface 62, so that no sharp corners are created along the front surface junction 64 or the back surface junction 66. There is, however, a small lip adjacent to the front surface junction 64 and the back surface junction 66, created, in part, by the pad 20.

FIGS. 2A-C illustrate the curvatures around the interfaces between the seat 58 and the toilet seat hinge 10 and between the lid 60 and the toilet seat hinge 10. The seat 58 has a seat attachment portion 68 that is connected to the first rotatable element 14 and slidably abuts the second rotatable element 16 and the first and second towers 22, 24. The lid 60 has a lid attachment portion 70 that is connected to the second rotatable element 16 and slidably abuts the first rotatable element 14 and the first and second towers 22, 24. The bottom surface of the lid attachment portion 70 and the top and bottom surfaces of the seat attachment portion 68 are curved to reduce or eliminate sharp corners where they meet the hinge 10. The top surface of the lid attachment portion 70 is generally straight because it is approximately tangential to the profile of the hinge 10 and therefore does not create a sharp corner where it meets the hinge.

In FIG. 2A, the seat 58 and the lid 60 are in the closed position. In FIG. 2B, the seat 58 is in the closed position and the lid 60 is in the open position. In FIG. 2C, both the seat 58 and the lid 60 are in the open position. By showing the various positions of the seat 58 and the lid 60, FIGS. 2A-C illustrate how the exposed surfaces of the first and second rotatable elements 14, 16 and the first and second towers 22, 24 remain in alignment as the seat and the lid are moved between the closed position and the open position.

Figure 3A:
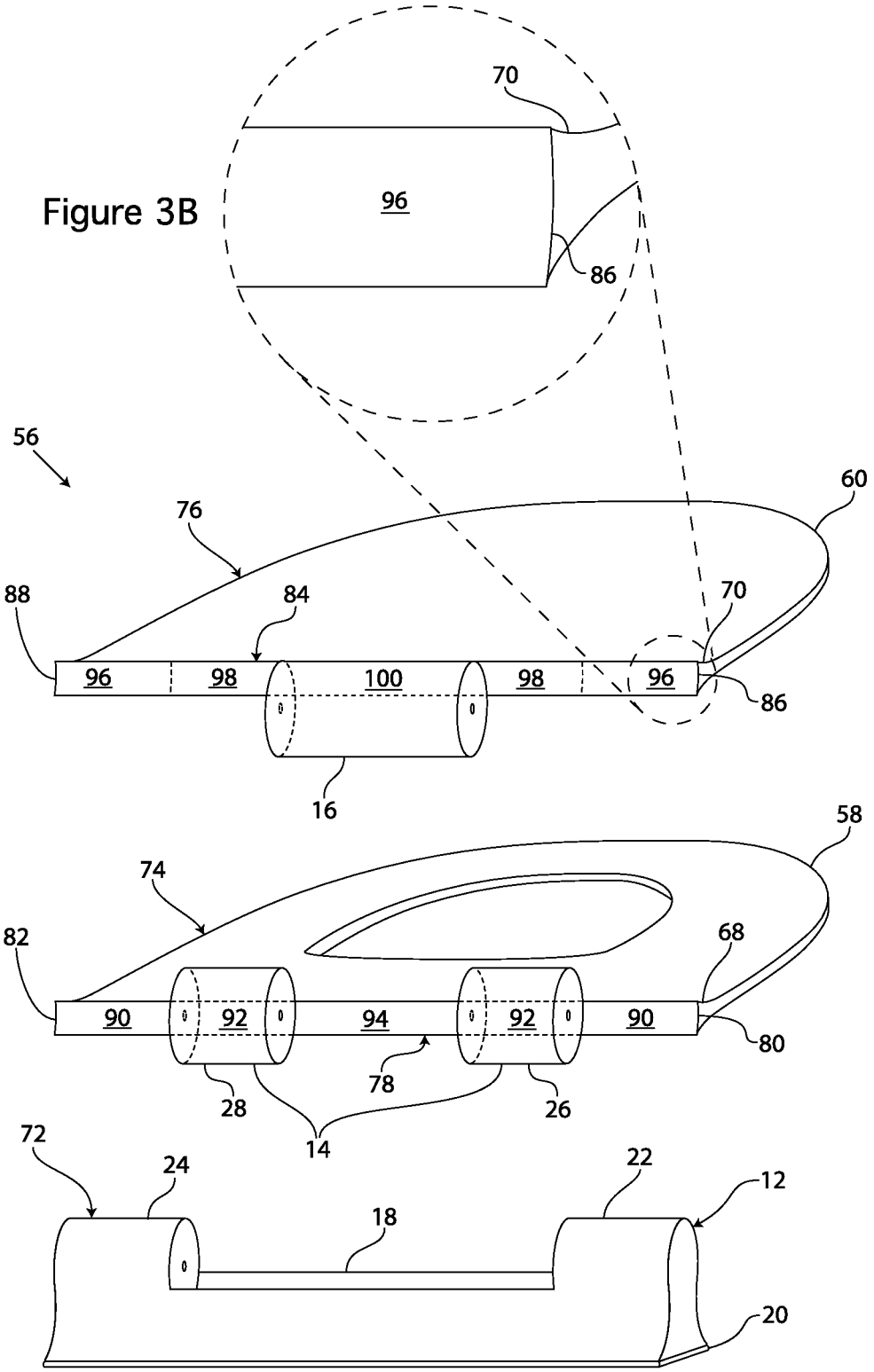
FIG. 3A is an exploded perspective view of the embodiment illustrated in FIGS. 1 and 2, as viewed from the top and back.

FIG. 3A is an exploded perspective view of the embodiment illustrated in FIGS. 1 and 2. FIG. 3B is an enlarged view of part of the exploded perspective view of FIG. 3A. The reference numerals from FIGS. 1 and 2 are carried over to FIGS. 3A and 3B. As shown in FIG. 3A, the toilet seat assembly 56 includes a first piece 72, a second piece 74, and a third piece 76. The first piece 72 includes the base 12, including the cradle 18, the pad 20, the first tower 22, and the second tower 24. The second piece 74 includes the seat 58 and the first rotatable element 14, including the first section 26 and the second section 28. The third piece 76 includes the lid 60 and the second rotatable element 16.

FIG. 3A illustrates the back sides of the seat 58 and the lid 60. The back side of the seat 58 has a middle portion 78 extending along the seat attachment portion 68 from a first endpoint 80 to a second endpoint 82. Similarly, the back side of the lid 60 has a middle portion 84 extending along the lid attachment portion 70 from a first endpoint 86 to a second endpoint 88. The middle portion 78 of the back side of the seat 58 and the middle portion 84 of the back side of the lid 60 each have surfaces that can be visualized in different sections. Beginning from the first and second endpoints 80, 82 and moving inward, the middle portion 78 of the back side of the seat 58 has a pair of first surface sections 90, a pair of second surface sections 92, and a third surface section 94. Similarly, beginning from the first and second endpoints 86, 88 and moving inward, the middle portion 84 of the back side of the lid 60 has a pair of first surface sections 96, a pair of second surface sections 98, and a third surface section 100. When the toilet seat assembly 56 is assembled, the first surface sections 90, 96 of the middle portions 78, 84 of the back sides of the seat and lid 58, 60 slidably abut the first and second towers 22, 24. The second surface sections 92 of the middle portion 78 of the back side of the seat 58 are attached to the first rotatable element 14. The second surface sections 98 of the middle portion 84 of the back side of the lid 60 slidably abut the first rotatable element 14. The third surface section 100 of the middle portion 84 of the back side of the lid 60 is attached to the second rotatable element 16. The third surface section 94 of the middle portion 78 of the back side of the seat 58 slidably abuts the second rotatable element 16. The surface sections of the middle portions 78, 84 of the back sides of the seat and lid 58, 60 that are not connected to one of the rotatable elements are concave to match the curvature of the rotatable elements and towers that they slidably abut. FIG. 3B illustrates the curvature of the first surface section 96 of the middle portion 84 of the back side of the lid 60 as well as the curvature of the top and bottom surfaces of the lid attachment portion 70.

Figure 4:
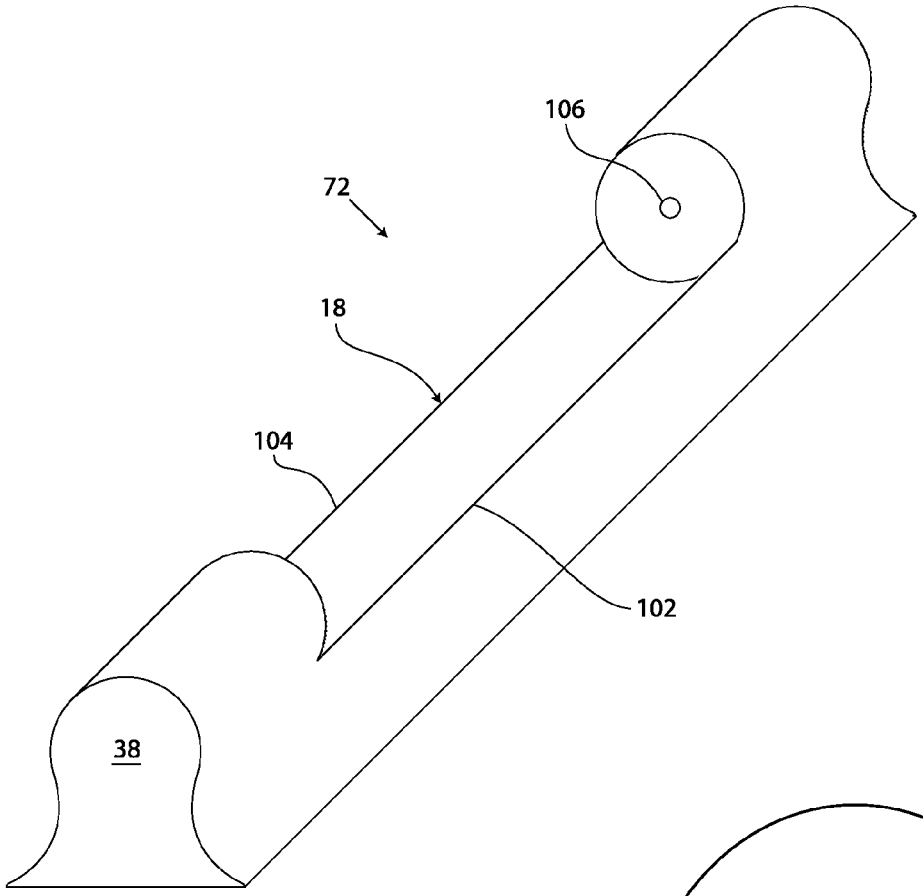
FIG. 4 is a perspective view of the first piece in the embodiment illustrated in FIGS. 1 and 2, as viewed from the top and front.

FIG. 4 is a perspective view of the first piece 72 presented at an angle to better illustrate the curvature of the cradle 18. The reference numerals from FIGS. 1-3 are carried over. The cradle 18 is designed to snugly support the first and second rotatable elements 14, 16 between a front section 102 and a back section 104. The front section 102 and the back section 104 extend up so that their outer surfaces are almost tangential to the curvature of the first and second rotatable elements 14, 16. This prevents sharp corners from being formed where the first and second rotatable elements 14, 16 emerge from the cradle 18. In the illustrated embodiment, the area between the front section 102 and the back section 104 is solid. In other embodiments, the area between the front and back sections can be partially or completely hollow.

The first and second rotatable elements 14, 16 are held in place by an axle that fits into a first tower axle hole (not shown) and a second tower axle hole 106. To assemble the toilet seat assembly 56, the axle can be strung through the first and second towers 22, 24 and the first and second rotatable elements 14, 16 via an access opening (not shown) on the side surface 38 of the toilet seat hinge 10. The access opening then can be plugged or can remain open for easy disassembly.

Figure 5:
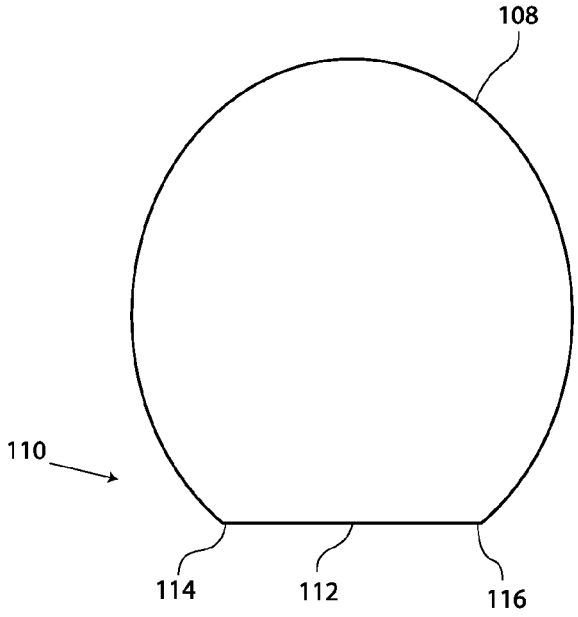
FIG. 5 is a top plan view of one embodiment of a lid compatible with some embodiments of the disclosed toilet seat assembly.

In the toilet seat assembly 56, the middle portion 78 of the back side of the seat 58 and the middle portion 84 of the back side of the lid 60 encompass essentially the entire back sides of the seat and lid, respectively. In some other embodiments, the seat and lid flare out from the middle portions of their respective back sides. FIG. 5 is a plan view of a lid 108 with a back side 110 that flares out from its middle portion 112. The middle portion 112 extends from a first endpoint 114 to a second endpoint 116. Some embodiments of the disclosed toilet seat assembly include a seat and a lid with middle portions having endpoints in vertical alignment when the toilet seat assembly is installed on a toilet body.

Figure 6:
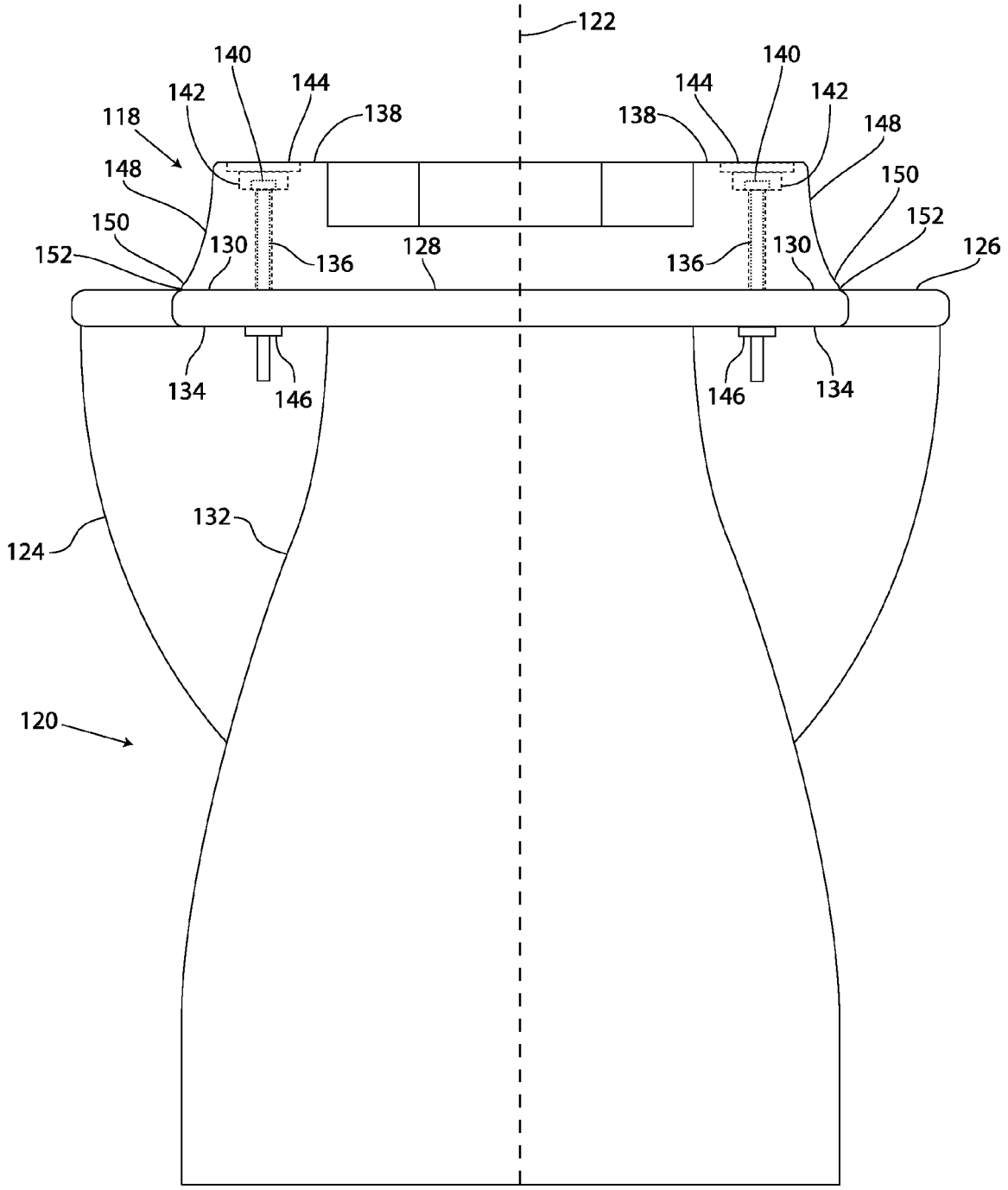
FIG. 6 is a back profile view of an embodiment of the disclosed toilet seat assembly installed on a toilet body.

FIG. 6 illustrates the hinge of another embodiment of the disclosed toilet seat assembly. In FIG. 6, a toilet seat hinge 118 is installed on a toilet body 120. The toilet seat hinge 118 and the toilet body 120 have an axis of symmetry 122. The toilet body 120 has a bowl 124 with a surface edge 126. As the surface edge 126 extends towards a tank (not shown) it turns into a mounting surface 128. The mounting surface 128 has side portions 130 on either side of a support 132. Each of the side portions 130 is perforated with a mounting hole (not shown). The mounting holes extend down through flat undersides 134 of the side portions 130.

The toilet seat hinge 118 is secured to the mounting surface 128 with bolts 136. The bolts 136 are positioned in bolt holes that extend through towers 138 in the toilet seat hinge 118. Each bolt 136 has a bolt head 140. The bolt heads 140 are positioned in openings 142 deep enough to recess the bolt heads 140 relative to the top surfaces of the towers 138. The openings 142 are covered by bolt hole covers 144. The bolt hole covers 144 are flush with the surface of the towers 138. Each bolt 136 is held in place by a nut 146 that presses against the flat underside 134 of one of the side portions 130 of the mounting surface 128.

Unlike the embodiment illustrated in FIGS. 1-4, the embodiment illustrated in FIG. 6 does not have a pad. Thus, the bottom surface of the toilet seat hinge 118 rests directly on the mounting surface 128. Also unlike the embodiment illustrated in FIGS. 1-4, the toilet seat hinge 118 has side surfaces 148 with flared bottom portions 150 that are concave. The flared bottom portions 150 of the side surfaces 148 meet the mounting surface 128 at side surface junctions 152 without creating any sharp corners along the side surface junctions 152.

Figure 7:
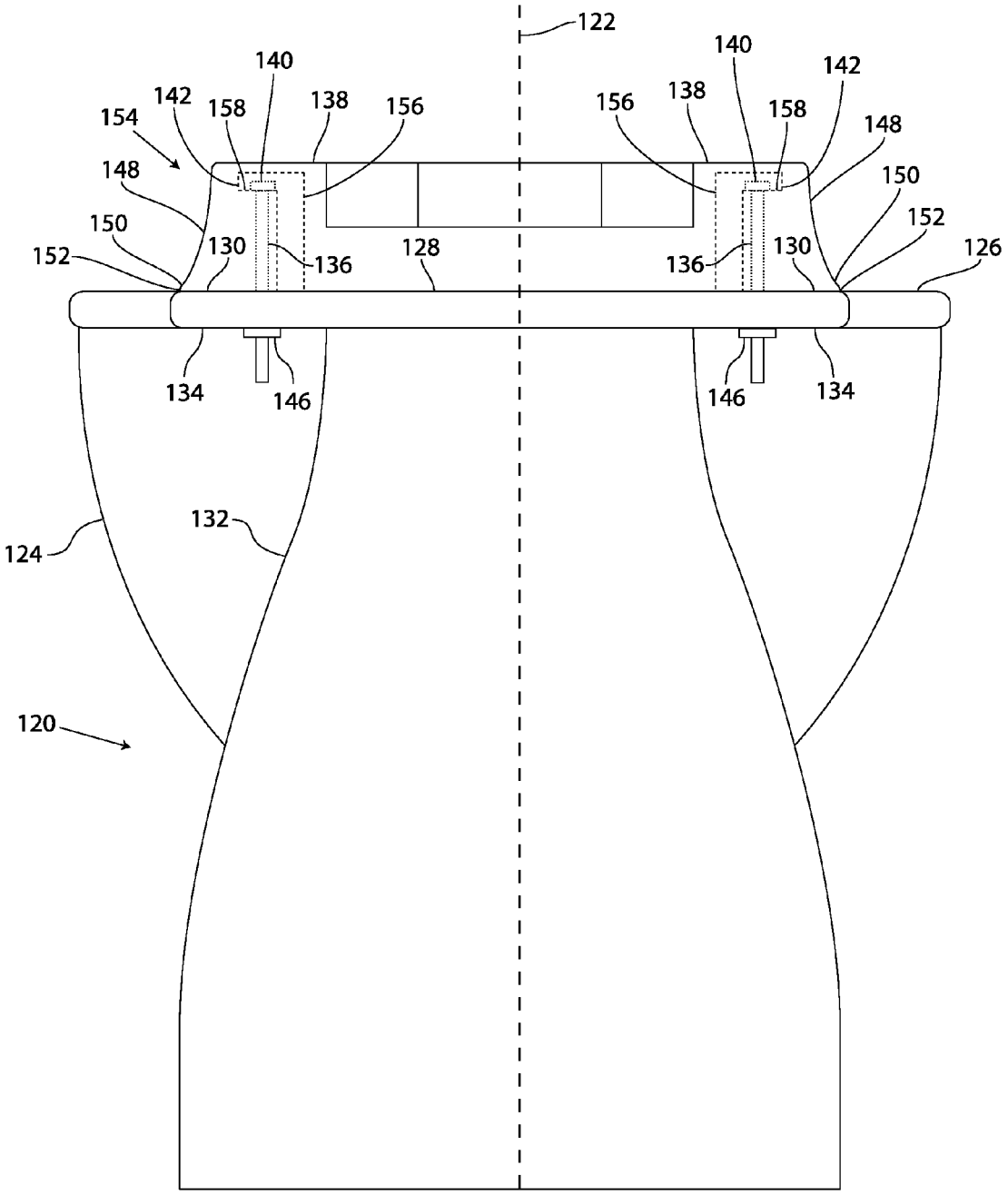
FIG. 7 is a back profile view of an embodiment of the disclosed toilet seat assembly installed on a toilet body.
Figure 8:
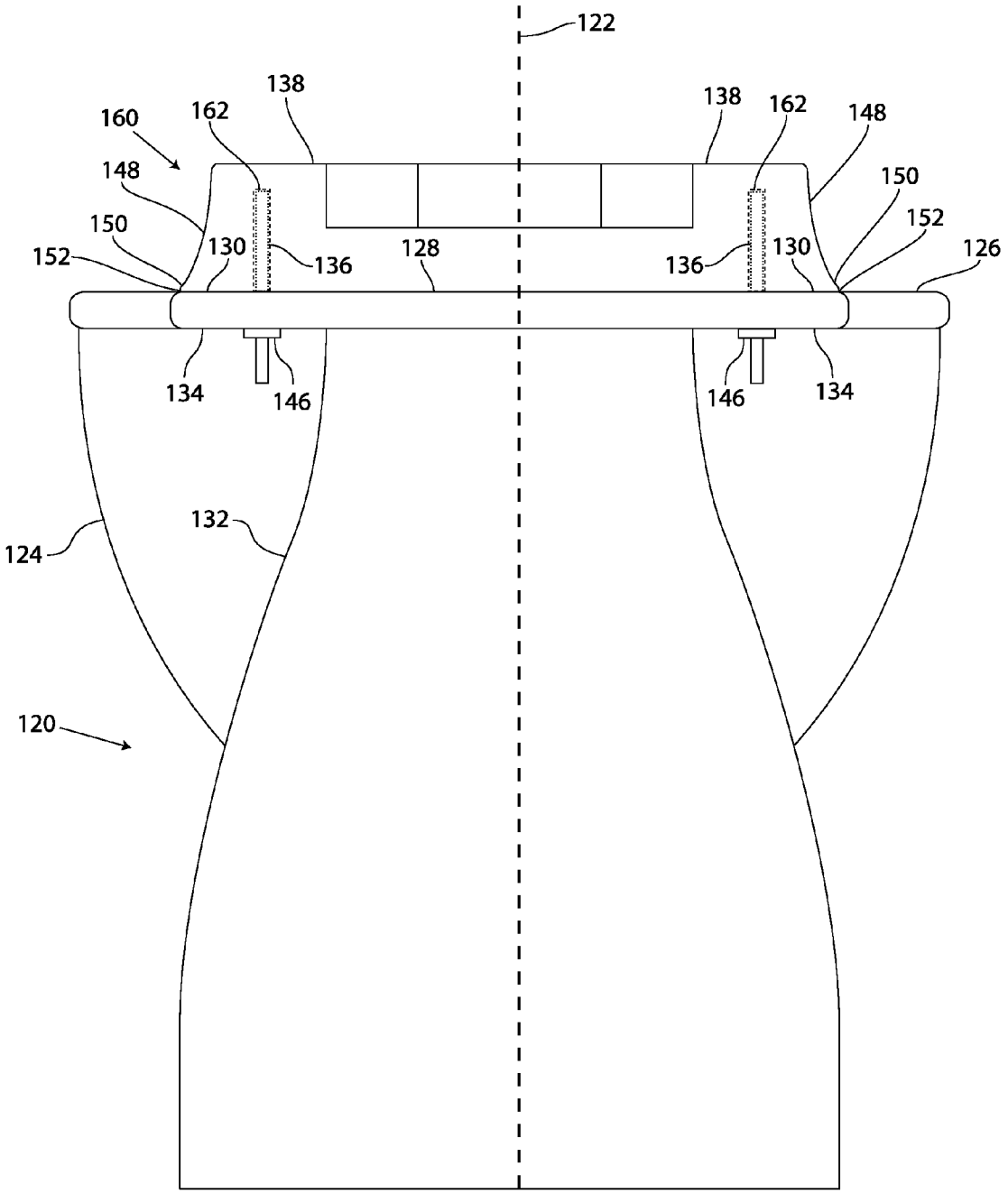
FIG. 8 is a back profile view of an embodiment of the disclosed toilet seat assembly installed on a toilet body.

FIGS. 7 and 8 illustrate hinges of embodiments of the disclosed toilet seat assembly similar to the hinge illustrated in FIG. 6, but with different bolt configurations. The reference numerals from FIG. 6 are carried over for similar or identical elements. These embodiments are designed to eliminate the need for bolt hole covers 144, which can interrupt otherwise continuous surfaces. Instead, the bolts 136 are attached solely from below through openings that are not exposed when these embodiments are installed on a toilet body 120. In the toilet seat hinge 154 illustrated in FIG. 7, each bolt 136 is lifted vertically through a bolt opening 156 and then shifted horizontally so that the bolt head 140 catches on a lip 158. The exposed portion of the bolt 136 then can be strung through the corresponding mounting hole and secured with a nut 146. In the toilet seat hinge 160 illustrated in FIG. 8, each bolt 136 is received by a threaded opening 162. As with the embodiment illustrated in FIG. 7, the bolt 136 then can strung through the corresponding mounting hole and secured with a nut 146. The bolt 136 need not have a bolt head.

Figure 9:
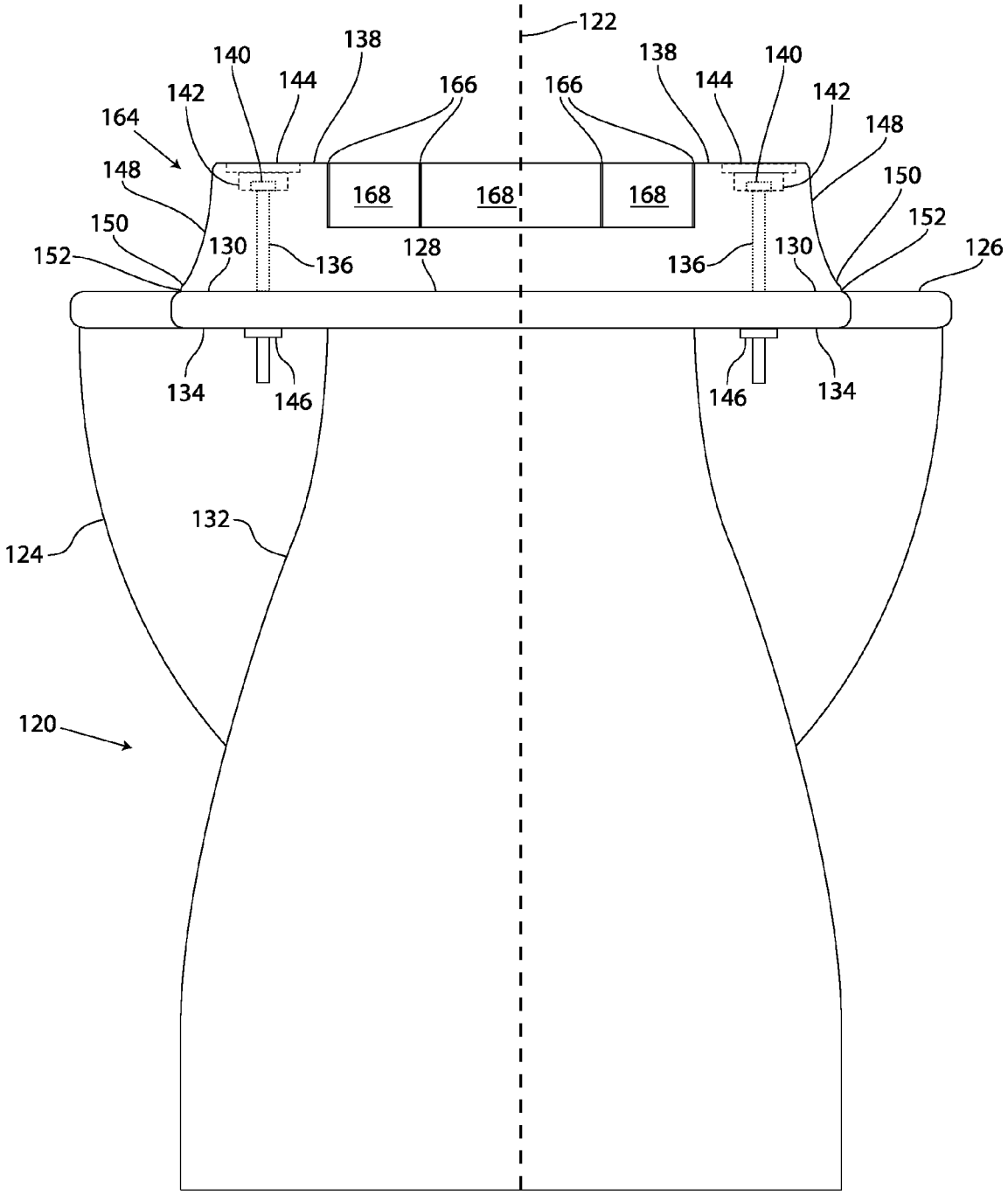
FIG. 9 is a back profile view of an embodiment of the disclosed toilet seat assembly installed on a toilet body.

FIG. 9 illustrates a hinge of another embodiment of the disclosed toilet seat assembly. The reference numerals from FIG. 6 are carried over for similar or identical elements. The illustrated toilet seat hinge 164 is similar to the toilet seat hinge 118 illustrated in FIG. 6, but with conformable pads 166 between the rotatable elements 168 and between the towers 138 and the rotatable elements 168. These conformable pads 166 help to provide a tight fit between the moving components and to provide the desired level of friction.

FIGS. 10-43 illustrate several additional embodiments of the disclosed toilet seat assembly. In these Figures, as in FIGS. 2A-2C, the full extent of the seats and lids are not shown so that the hinges and the back portions of the seats and lids can be shown in greater detail. The seats and lids are cut off at arbitrary positions near the hinges. In the perspective and front profile views, a dashed line surrounds the cross-sections of the seats and lids at the cut-offs. Conventional seat and lid designs can be incorporated into the disclosed embodiments as extensions of the illustrated seat and lid back portions beginning, for example, at the illustrated cut-offs or at other positions closer to the hinges.

FIGS. 10-15 illustrate a toilet seat assembly 170 including a hinge 172, a lid 174, and a seat 176. The hinge 172 includes a cradle 178, a first tower 180, a second tower 182, a first rotatable element 184, a second rotatable element 186, and a third rotatable element 188. The cradle 178, the first tower 180, and the second tower 182 are fixed when the toilet seat assembly 170 is mounted on a mounting surface of a toilet body. The first rotatable element 184 and the third rotatable element 188 are connected to the seat 176. The second rotatable element 186 is connected to the lid 174. Bolt openings (not shown) for mounting the toilet seat assembly 170 to the mounting surface of a toilet body are positioned below the first and second towers 180, 182.

Figure 10:
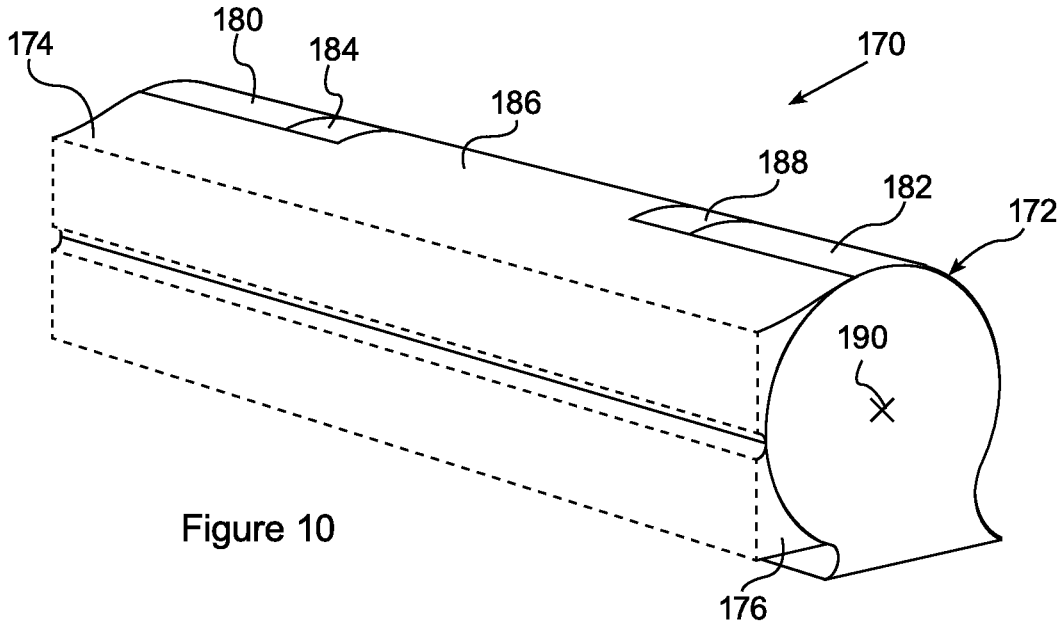
FIG. 10 is a perspective view of an embodiment of the disclosed toilet seat assembly with the seat and lid truncated, as viewed from the top and front.

The first rotatable element 184, the second rotatable element 186, and the third rotatable element 188 rotate on an axis 190 (marked with an "x" in FIG. 10). Compared to the embodiment shown in FIGS. 1-4, the axis 190 is shifted forward (i.e., toward the bowl when the toilet seat assembly 170 is mounted on a toilet body). This allows the hinge 172 to have a lower profile while keeping the concavity at the back junction between the hinge and the mounting surface of the toilet body relatively shallow. A shallow concavity typically is easier to clean than a deep concavity.

Figure 11:
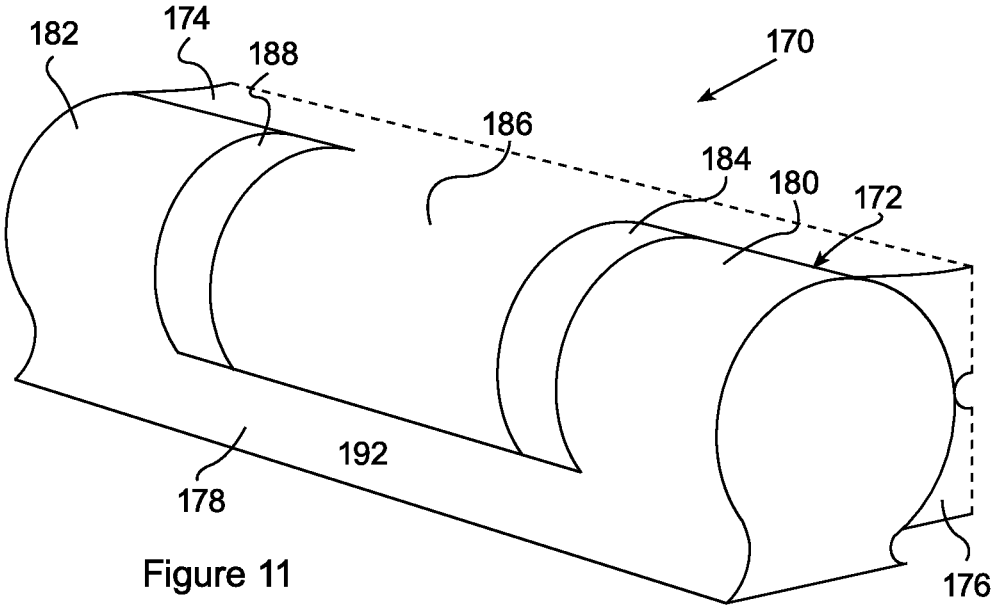
FIG. 11 is a perspective view of the embodiment illustrated in FIG. 10, as viewed from the top and back.
Figure 12:
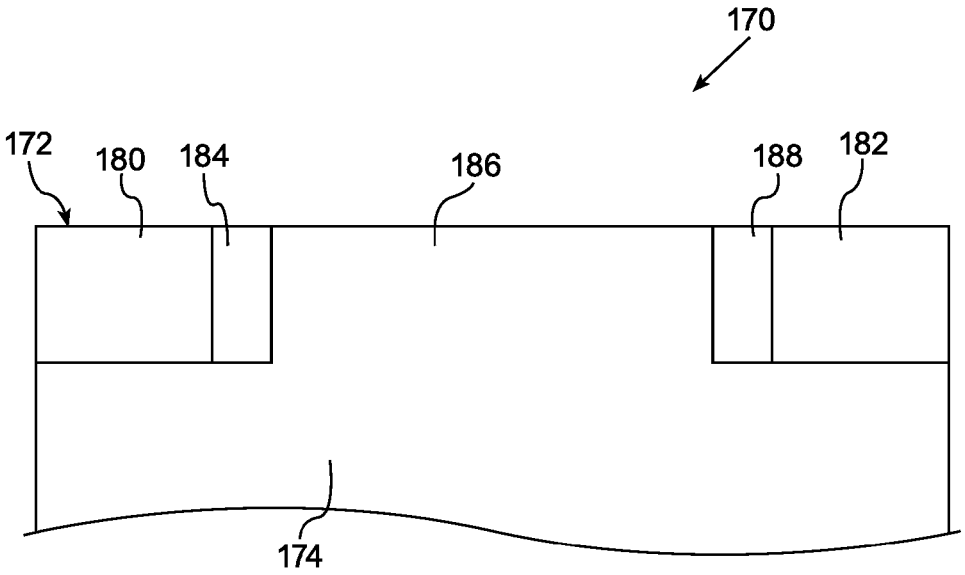
FIG. 12 is a top plan view of the embodiment illustrated in FIG. 10.
Figure 13:
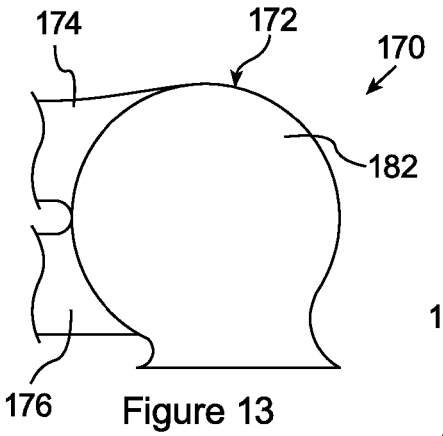
FIG. 13 is a side profile view of the embodiment illustrated in FIG. 10 with the seat and lid closed.
Figure 14:
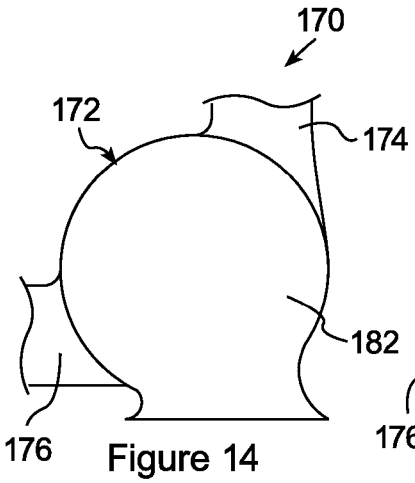
FIG. 14 is a side profile view of the embodiment illustrated in FIG. 10 with the seat closed and the lid open.
Figure 15:
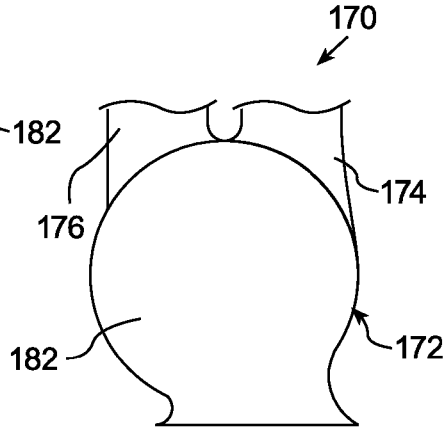
FIG. 15 is a side profile view of the embodiment illustrated in FIG. 10 with the seat and lid open.
Figure 16:
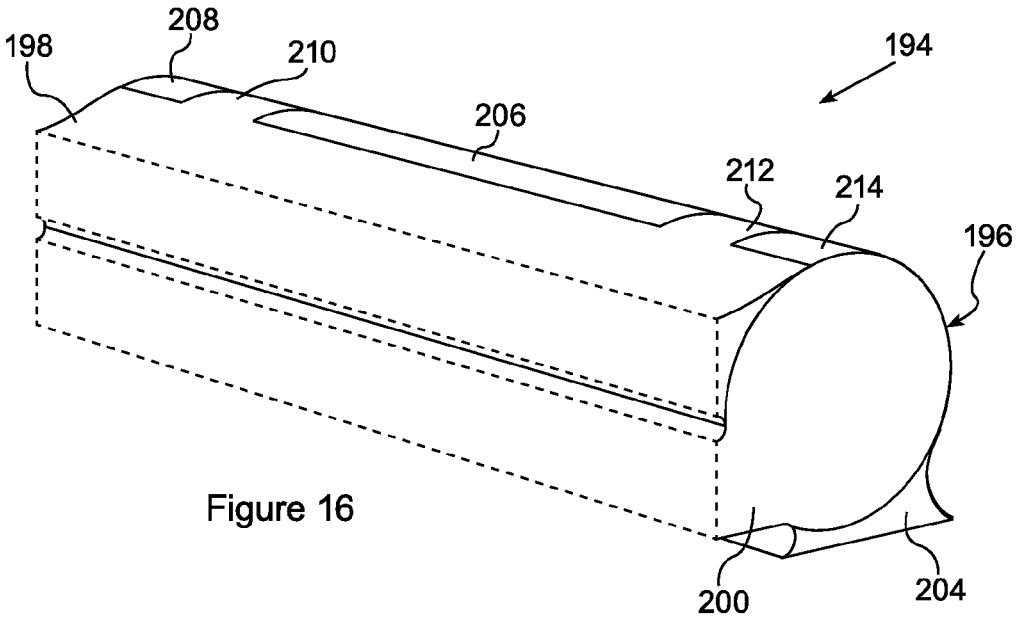
FIG. 16 is a perspective view of an embodiment of the disclosed toilet seat assembly with the seat and lid truncated, as viewed from the top and front.
Figure 17:
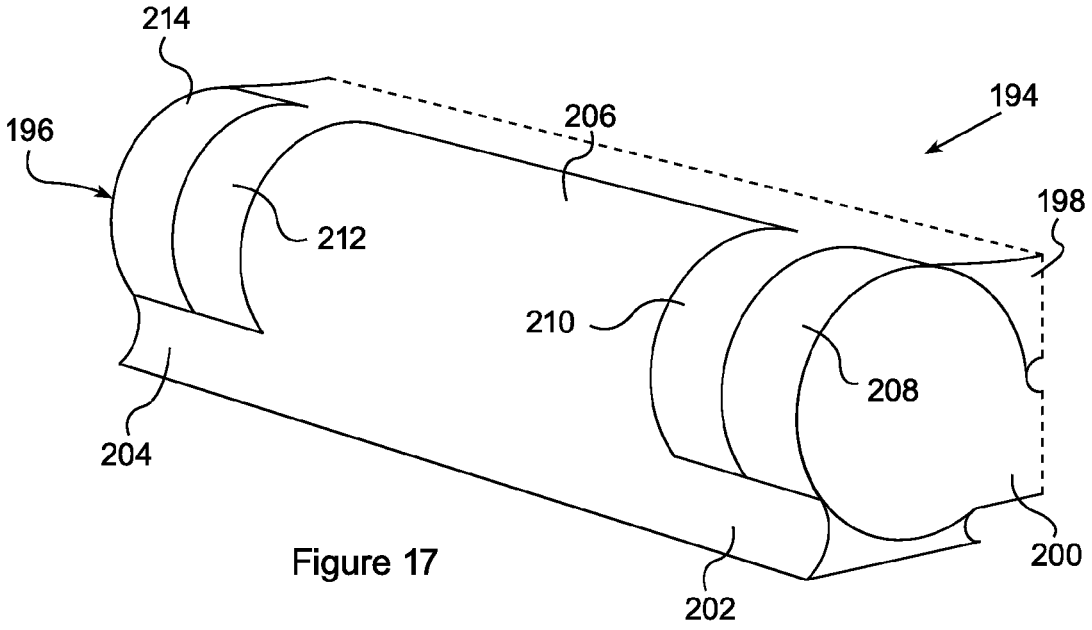
FIG. 17 is a perspective view of the embodiment illustrated in FIG. 16, as viewed from the top and back.
Figure 18:
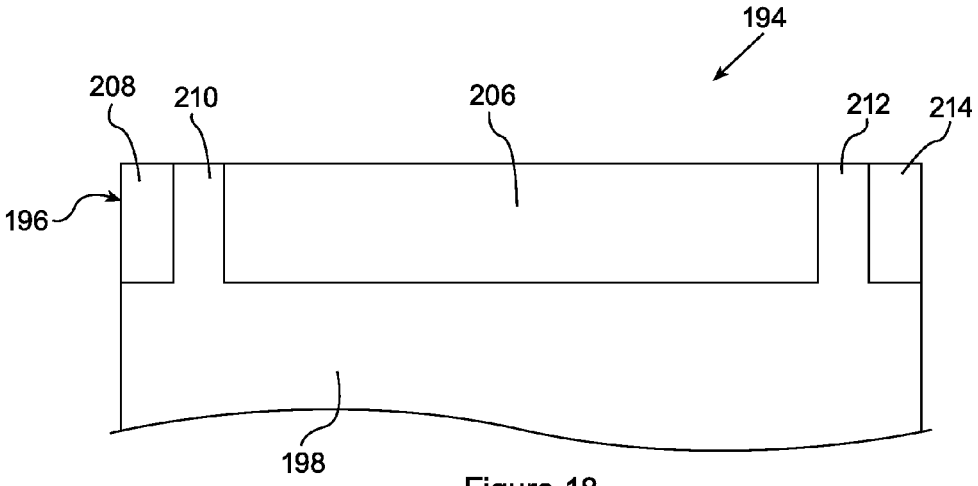
FIG. 18 is a top plan view of the embodiment illustrated in FIG. 16.
Figure 19:
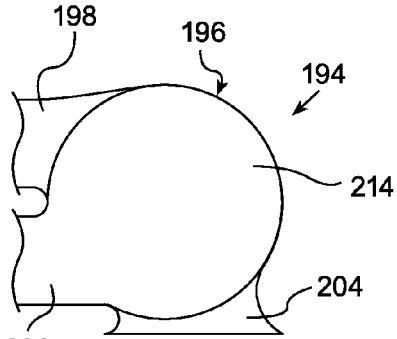
FIG. 19 is a side profile view of the embodiment illustrated in FIG. 16 with the seat and lid closed.
Figure 20:
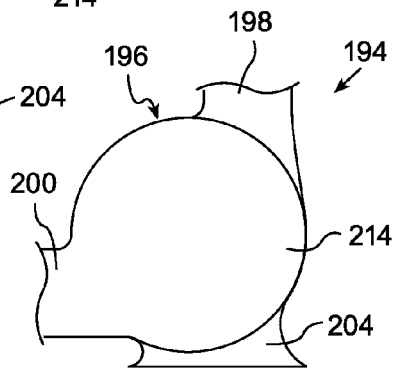
FIG. 20 is a side profile view of the embodiment illustrated in FIG. 16 with the seat closed and the lid open.
Figure 21:
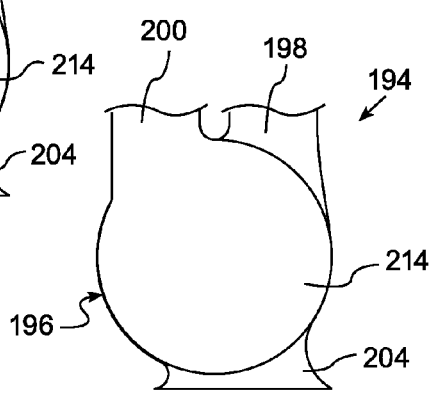
FIG. 21 is a side profile view of the embodiment illustrated in FIG. 16 with the seat and lid open.
Figure 22:
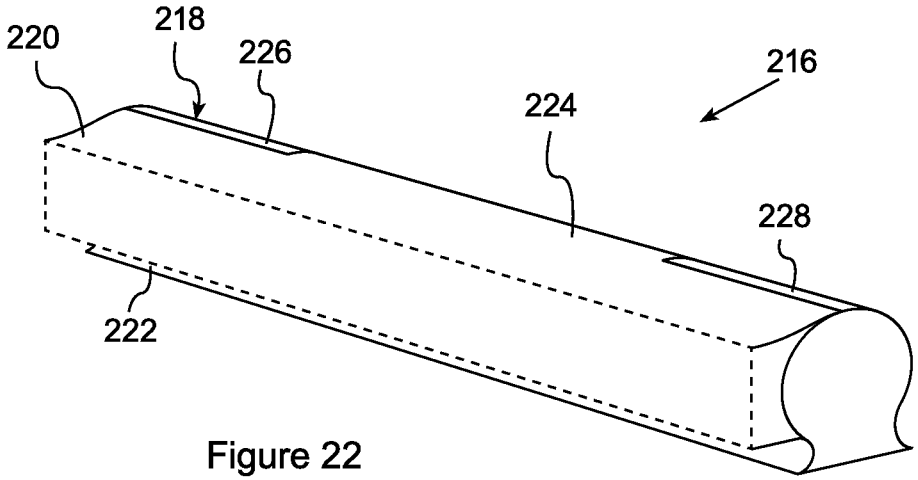
FIG. 22 is a perspective view of an embodiment of the disclosed toilet seat assembly with the seat truncated, as viewed from the top and front.
Figure 23:
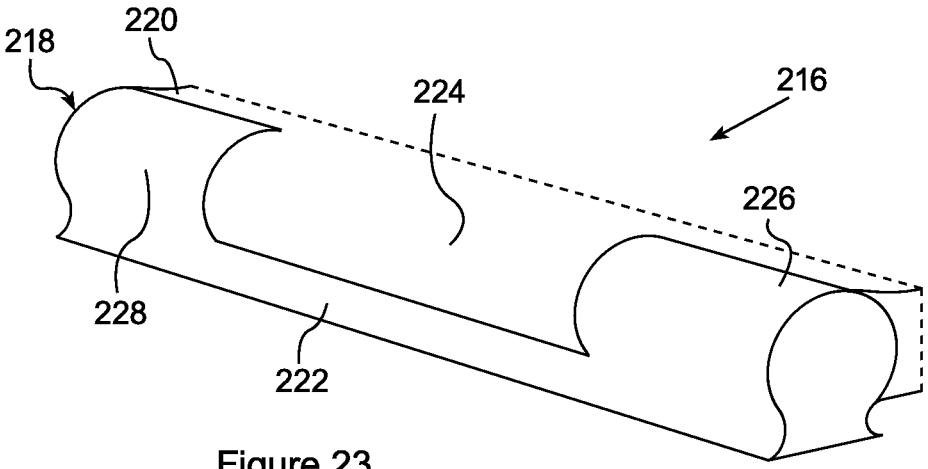
FIG. 23 is a perspective view of the embodiment illustrated in FIG. 22, as viewed from the top and back.
Figure 24:
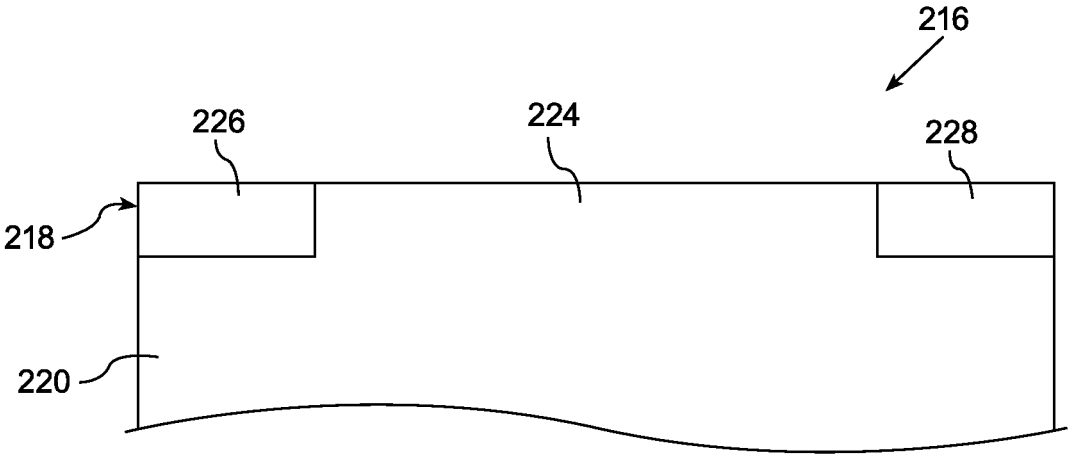
FIG. 24 is a top plan view of the embodiment illustrated in FIG. 22.
Figure 25:
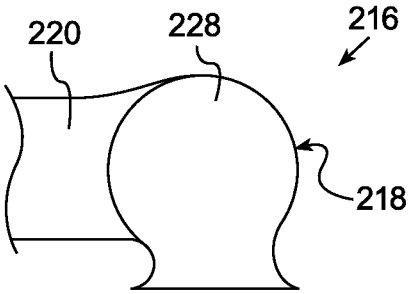
FIG. 25 is a side profile view of the embodiment illustrated in FIG. 22 with the seat closed.
Figure 26:
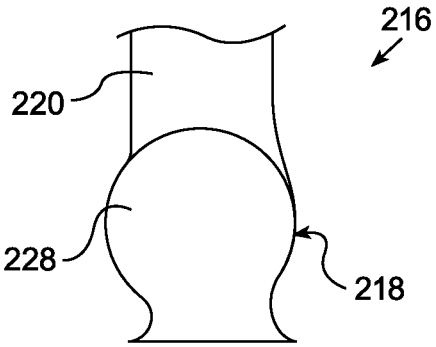
FIG. 26 is a side profile view of the embodiment illustrated in FIG. 22 with the seat open.
Figure 27:
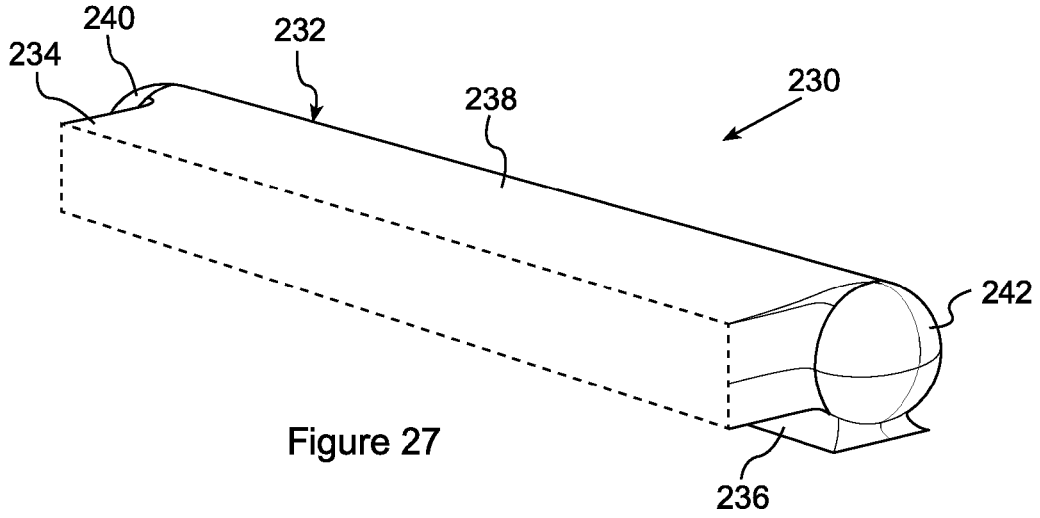
FIG. 27 is a perspective view of an embodiment of the disclosed toilet seat assembly with the seat truncated, as viewed from the top and front.
Figure 28:
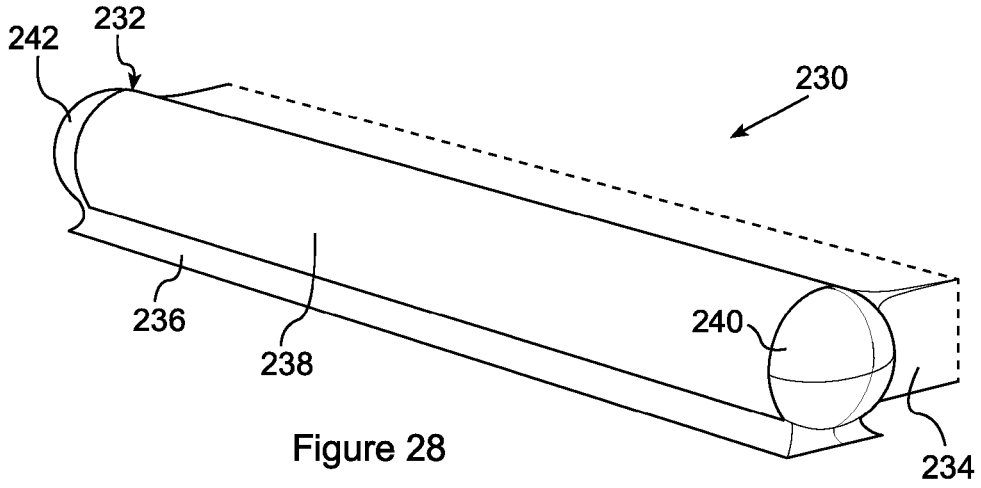
FIG. 28 is a perspective view of the embodiment illustrated in FIG. 27, as viewed from the top and back.
Figure 29:
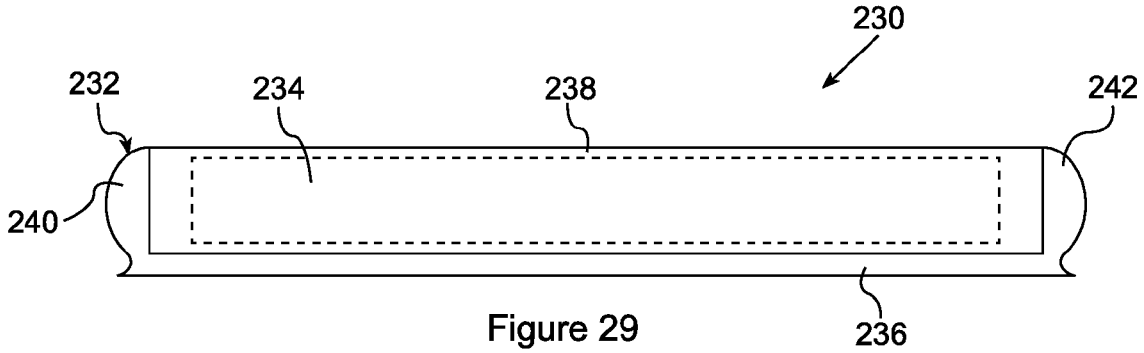
FIG. 29 is a front profile view of the embodiment illustrated in FIG. 27.
Figure 30:
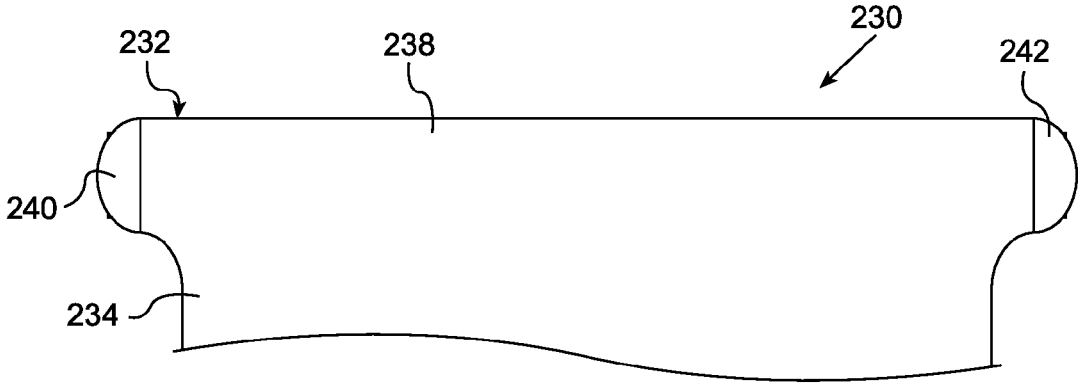
FIG. 30 is a top plan view of the embodiment illustrated in FIG. 27.
Figure 31:
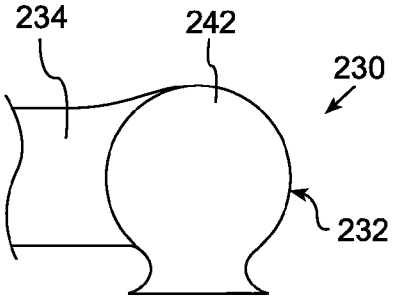
FIG. 31 is a side profile view of the embodiment illustrated in FIG. 27 with the seat closed.
Figure 32:
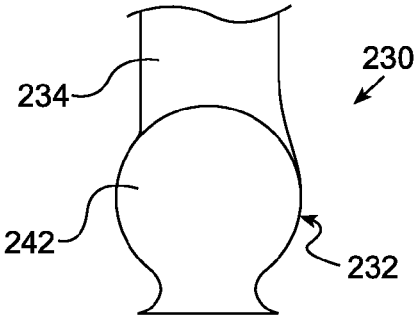
FIG. 32 is a side profile view of the embodiment illustrated in FIG. 27 with the seat open.
Figure 33:
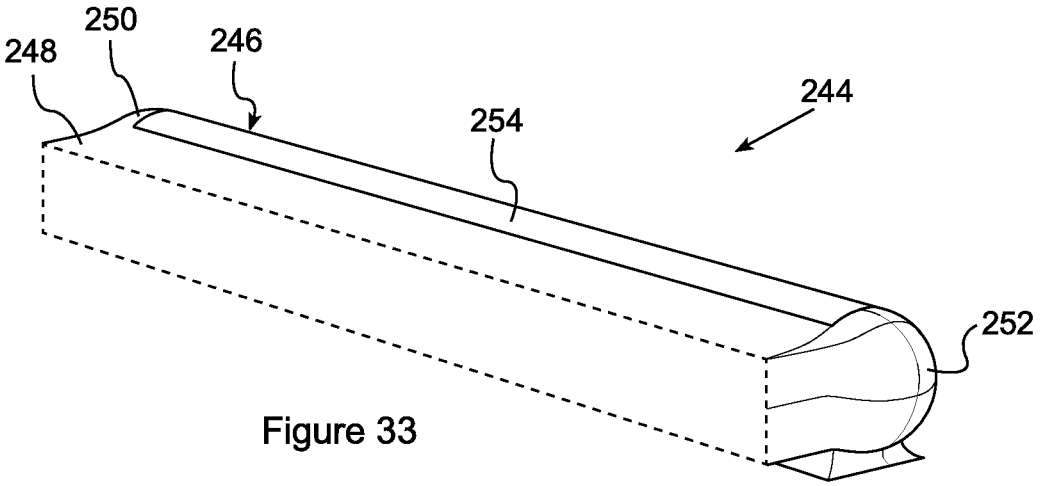
FIG. 33 is a perspective view of an embodiment of the disclosed toilet seat assembly with the seat truncated, as viewed from the top and front.
Figure 34:
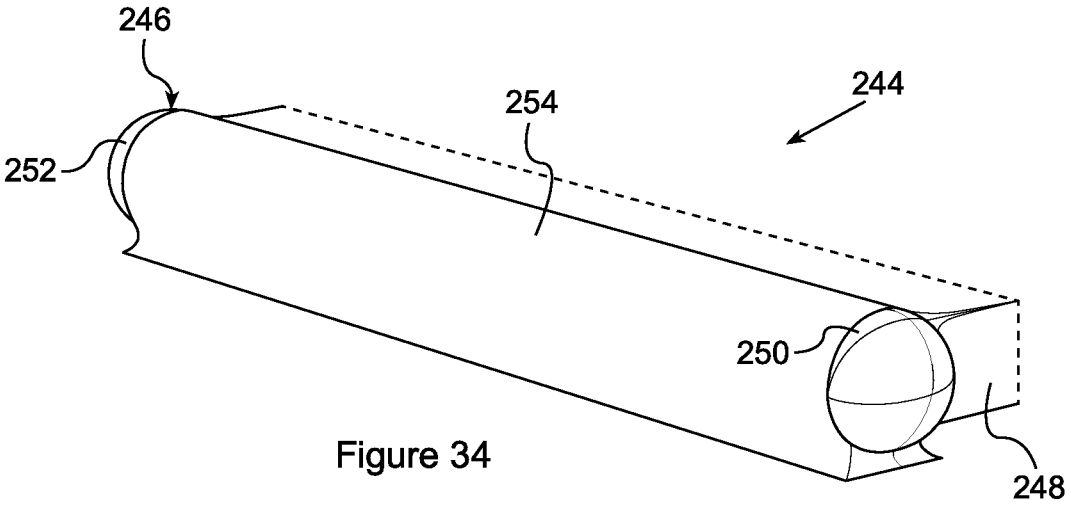
FIG. 34 is a perspective view of the embodiment illustrated in FIG. 33, as viewed from the top and back.
Figure 35:
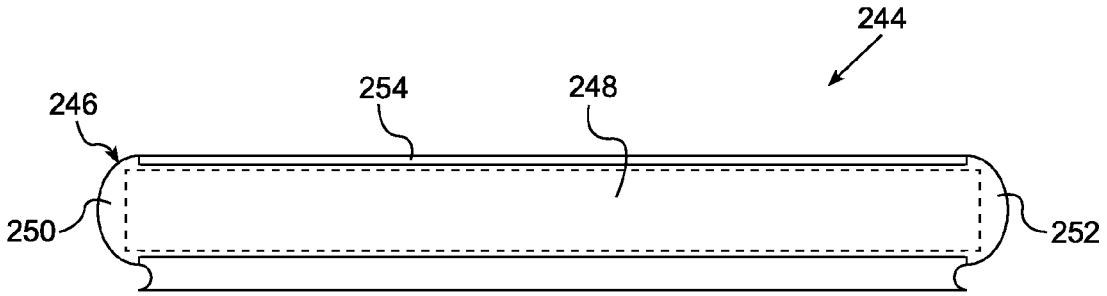
FIG. 35 is a front profile view of the embodiment illustrated in FIG. 33.
Figure 36:
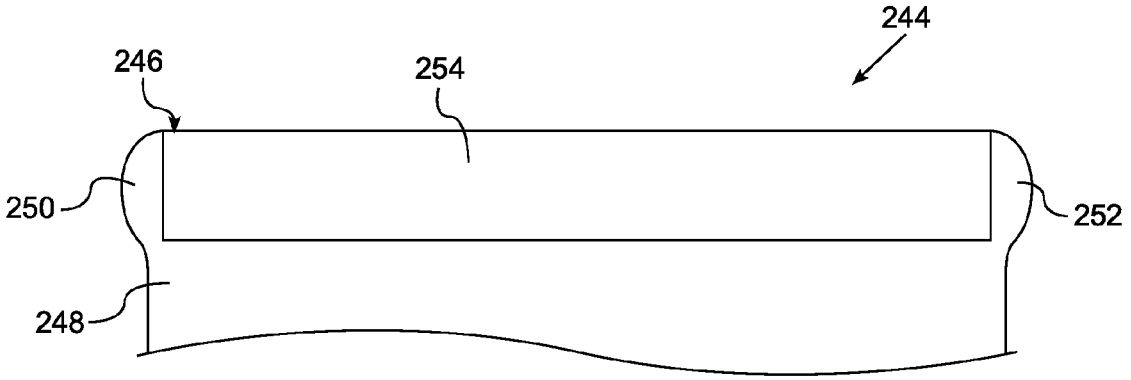
FIG. 36 is a top plan view of the embodiment illustrated in FIG. 33.
Figure 37:
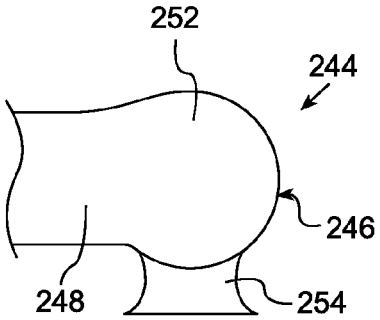
FIG. 37 is a side profile view of the embodiment illustrated in FIG. 33 with the seat closed.
Figure 38:
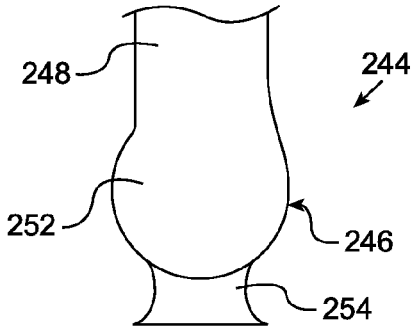
FIG. 38 is a side profile view of the embodiment illustrated in FIG. 33 with the seat open.

The cradle 178 of the toilet seat assembly 170 shown in FIGS. 10-15 includes a front wall (not shown) and a back wall 192 (shown in FIG. 11). The front wall and the back wall 192 are detached from each other, with a hollow space in between. Thus, the cradle 178 covers portions of the convex surfaces of the first rotatable element 184, the second rotatable element 186, and the third rotatable element 188 by slidably abutting them along top surfaces of the front wall and the back wall 192 only. Some other embodiments include a cradle that is solid between its front and back surfaces and slidably abuts convex surfaces of one or more rotatable elements along an entire concave surface spanning between the cradle's front and back surfaces.

FIGS. 16-21 illustrate a toilet seat assembly 194 similar to the toilet seat assembly 170 shown in FIGS. 10-15, but with a different configuration of hinge elements. The toilet seat assembly 194 shown in FIGS. 16-21 includes a hinge 196, a lid 198, and a seat 200. The hinge 196 includes a first cradle 202, a second cradle 204, a tower 206, a first rotatable element 208, a second rotatable element 210, a third rotatable element 212, and a fourth rotatable element 214. The first cradle 202, the second cradle 204, and the tower 206 are fixed when the toilet seat assembly 194 is mounted on a mounting surface of a toilet body. The first rotatable element 208 and the fourth rotatable element 214 are connected to the seat 200. The second rotatable element 210 and the third rotatable element 212 are connected to the lid 198. Bolt openings (not shown) for mounting the toilet seat assembly 194 to the mounting surface of a toilet body are positioned within the first cradle 202 and the second cradle 204 below the first rotatable element 208 and the fourth rotatable element 214.

In contrast to the toilet seat assembly 170 shown in FIGS. 10-15, the toilet seat assembly 194 shown in FIGS. 16-21 includes a single tower (instead of two towers), which is positioned between the rotatable elements (instead of on either side of the rotatable elements). Other embodiments of the disclosed toilet seat assembly can have other configurations of rotatable and fixed elements within the hinge. For example, a rotatable element attached to the seat can be positioned between a fixed tower and a rotatable element attached to the lid. In both the toilet seat assembly 170 shown in FIGS. 10-15 and the toilet seat assembly 194 shown in FIGS. 16-21, the rotatable and fixed elements are distributed symmetrically about an axis of symmetry corresponding to an axis of symmetry of a toilet body onto which the hinges are configured for installation. Other embodiments can include nonsymmetrical configurations of rotatable and fixed elements within the hinge. For example, a rotatable element attached to the seat and a rotatable element attached to the lid can be positioned on either side of a centrally positioned fixed tower. The seat and the lid in embodiments of the disclosed toilet seat assembly can be connected to one, two, three, four, or a greater number of distinct rotatable elements. Similarly, rotatable elements connected to a seat or a lid in embodiments of the disclosed toilet seat assembly can include one, two, three, four, or a greater number of distinct sections.

FIGS. 22-38 illustrate three embodiments of the disclosed toilet seat assembly that do not include a lid. FIGS. 22-26 illustrate a toilet seat assembly 216 including a hinge 218 and a seat 220. The hinge 218 includes a cradle 222, a rotatable element 224, a first tower 226, and a second tower 228. The cradle 222, the first tower 226, and the second tower 228 are fixed when the toilet seat assembly 216 is mounted on a mounting surface of a toilet body. The rotatable element 224 is connected to the seat 220. Bolt openings (not shown) for mounting the toilet seat assembly 216 to the mounting surface of a toilet body are positioned below the first tower 226 and the second tower 228. FIGS. 27-32 illustrate a toilet seat assembly 230 including a hinge 232 and a seat 234. The hinge 232 includes a cradle 236, a rotatable element 238, a first tower 240, and a second tower 242. The cradle 236, the first tower 240, and the second tower 242 are fixed when the toilet seat assembly 230 is mounted on a mounting surface of a toilet body. The rotatable element 238 is connected to the seat 234. Bolt openings (not shown) for mounting the toilet seat assembly 230 to the mounting surface of a toilet body are positioned within the cradle 236 below the rotatable element 238. FIGS. 33-38 illustrate a toilet seat assembly 244 including a hinge 246 and a seat 248. The hinge 246 includes a first rotatable element 250, a second rotatable element 252, and a tower 254. The tower 254 is fixed when the toilet seat assembly 244 is mounted on a mounting surface of a toilet body. The first rotatable element 250 and the second rotatable element 252 are connected to the seat 248. Bolt openings (not shown) for mounting the toilet seat assembly 244 to the mounting surface of a toilet body are positioned within the tower 254.

The toilet seat assemblies 216, 230, 244 shown in FIGS. 22-38 illustrate three examples of reduction or elimination of gaps and/or sharp corners in toilet seat assemblies that do not include a lid. The toilet seat assembly 216 shown in FIGS. 22-26 includes straight side surfaces, while the toilet seat assemblies 230, 244 shown in FIGS. 27-38 include rounded side surfaces. The rounding is highlighted in portions of FIGS. 27-28 and 33-34 using shade lines in a lighter weight than the other lines of the Figures. Similar rounding can be incorporated into embodiments of the disclosed toilet seat assembly that include both a seat and a lid.

FIGS. 13-15, 19-21, 25-26, 31-32, and 37-38 are side profile views of the toilet seat assemblies 170, 194, 216, 230, 244 with the seats 176, 200, 220, 234, 248 and the lids 174, 198 (where present) in different positions. In the illustrated embodiments, the seats and lids generally contact front portions of the hinges (i.e., portions closer to the bowl when the toilet seat assemblies are installed on a toilet body) and extend away from the hinges horizontally when the seats and lids are closed. In other disclosed embodiments, the seat and/or lid can contact another portion of the hinge when the seat and/or lid is closed. For example, a bottom surface near the back of a lid (or of a seat when no lid is present), can contact a top surface of the hinge. The back portion of the seat and/or lid also can extend away from the hinge at an angle when the seat and/or lid is closed.

Figure 39:
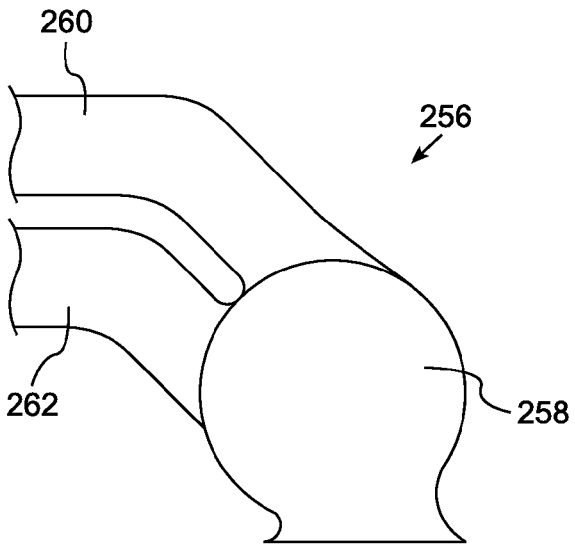
FIG. 39 is a side profile view of an embodiment of the disclosed toilet seat assembly with the seat and lid closed.
Figure 40:
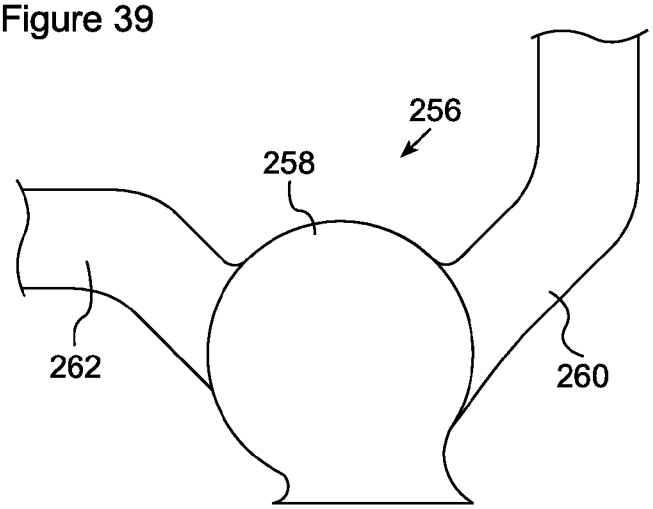
FIG. 40 is a side profile view of the embodiment illustrated in FIG. 39 with the seat closed and the lid open.
Figure 41:
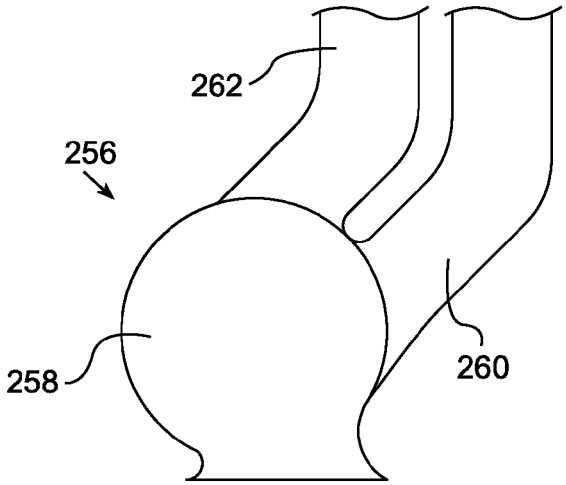
FIG. 41 is a side profile view of the embodiment illustrated in FIG. 39 with the seat and lid open.
Figure 42:
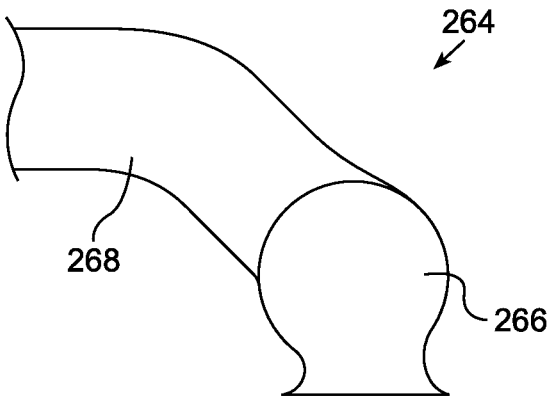
FIG. 42 is a side profile view of an embodiment of the disclosed toilet seat assembly with the seat closed.
Figure 43:
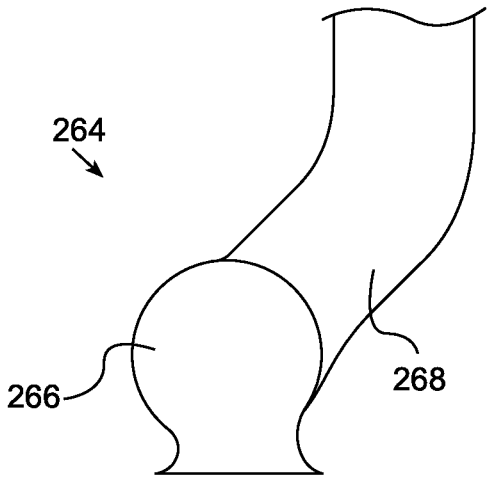
FIG. 43 is a side profile view of the embodiment illustrated in FIG. 42 with the seat open.

In embodiments in which the back portion of the seat and/or lid extends away from the hinge at an angle when the seat and/or lid is closed, the portion of the convex surface of the hinge at which the seat and/or lid contacts the hinge (e.g., is attached to or slidably abuts the hinge) can be different than what is shown in FIGS. 13-15, 19-21, 25-26, 31-32, and 37-38. For example, FIGS. 39-41 are side profile views of a toilet seat assembly 256 including a hinge 258, a lid 260, and a seat 262. The back portions of the lid 260 and the seat 262 extend away from the hinge 258 at upward angles when the seat and the lid are closed. This causes the region of the surface of the hinge 258 along which the lid 260 and the seat 262 contact the hinge as the seat and lid are opened to be radially rearward (i.e., away from the bowl when the toilet seat assembly 256 is installed on a toilet body) relative to what is shown, for example, in FIGS. 13-15. Similarly, FIGS. 42-43 are side profile views a toilet seat assembly 264 including a hinge 266 and a seat 268. The back portion of the seat 268 extends away from the hinge 266 at an upward angle when the seat is closed. This causes the region of the surface of the hinge 266 along which the seat 268 contacts the hinge as the seat is opened to be radially rearward (i.e., away from the bowl when the toilet seat assembly 264 is installed on a toilet body) relative to what is shown, for example, in FIGS. 25-26.

The embodiments illustrated in FIGS. 1-43 and other embodiments of the disclosed toilet seat assembly and hinges for incorporation into a toilet seat assembly have one or more features that are not found in conventional toilet seat assemblies and hinges. Some of these features are further described in the following subsections. As with the embodiments described above, the features described in the following subsections are exemplary only and not intended to limit the scope of the overall disclosure.

Reducing or Eliminating Gaps

Some embodiments of the disclosed toilet seat assembly are designed to reduce or eliminate gaps found in and around conventional toilet seat hinges when these hinges are installed on a toilet body. For example, some disclosed embodiments substantially cover the portion of the mounting surface between the mounting holes on a toilet body, such as a standard toilet body. This can, for example, reduce or eliminate the gap that is found between the brackets of conventional toilet seat hinges.

Some embodiments of the disclosed toilet seat assembly include hinges that cover a larger portion of the mounting surface than conventional toilet seat hinges. For example, while most conventional toilet seat hinges only cover two separate patches of the mounting surface, the hinge of some disclosed embodiments covers a continuous path between the mounting holes. The hinge, for example, can have a unified footprint on the mounting surface that encompasses or surrounds the mounting holes. This footprint can be created by a base that is connected to the mounting holes. In some disclosed embodiments, the base has a bottom surface that contacts the mounting surface. The bottom surface of the base can be continuous or non-continuous. To cover a portion of the mounting surface, the hinge need not contact all portions of the covered area, especially internal portions of the covered area. In some disclosed embodiments, the base or bottom portion of the hinge is a shell that covers a portion of the mounting surface by contacting the mounting surface at the bottom edge of its perimeter (e.g., the bottom edge of its front, back, and side surfaces).

Toilet bodies typically are symmetrical and have an axis of symmetry extending from the front of the bowl to the back of the tank. Some hinges of embodiments of the disclosed toilet seat assembly are configured to mount to the toilet body substantially centered on the axis of symmetry near the rear of the bowl. In contrast, as mentioned above, conventional toilet seat assemblies typically include brackets that are spaced apart on either side of the axis of symmetry.

As illustrated in the Figures and discussed above, embodiments of the disclosed toilet seat assembly can include a hinge having a base that supports one or more rotatable elements. The rotatable elements can be positioned, for example, between or around one or more towers. The towers can be configured so that they are directly above the mounting holes when the hinge is installed on a standard toilet body. In some disclosed embodiments, the base includes a first tower and a second tower and these towers support at least a first rotatable element and a second rotatable element. Portions of the rotatable elements can be positioned, for example, on either side of the towers or between the towers. The first and second towers can support the rotatable elements, for example, by supporting one or more axles about which the rotatable elements rotate. In some disclosed embodiments, a single axle connects each rotatable element. In other disclosed embodiments, multiple axles connect the rotatable elements. For example, a separate axle can be present at each connection point. In still other disclosed embodiments, mating recesses and protrusions connect the rotatable elements. In form, the rotatable elements can include, for example, one or more rounded elements configured for attachment to the seat or lid.

In some embodiments of the disclosed toilet seat assembly, a first rotatable element is attached to a seat and a second rotatable element is attached to a lid. The first and second rotatable elements can allow the movement of the seat and lid, respectively, by rotating from a first angle to a second angle. The first and second angles can be separated by a range sufficient to allow the seat and lid to move between a closed position and an open position. This can be a range, for example, from about 70° to about 120°, such as from about 80° to about 110° or from about 90° to about 100°. In some disclosed embodiments, the first and second rotatable elements rotate on substantially the same axis. This axis can be curved or straight.

In embodiments of the disclosed toilet seat assembly including a seat and a lid, the seat and lid can have back sides with middle portions. The middle portions can be portions centered on the hinge and bisected by the toilet body's axis of symmetry. Each middle portion can have a width, for example, between about 2 centimeters and about 30 centimeters, such as between about 10 centimeters and about 25 centimeters, or between about 15 centimeters and about 23 centimeters. In some disclosed embodiments, the middle portions are at least partially connected to the hinge. The middle portions of the back sides of the seat and lid on conventional toilet seat hinges typically include exposed edges that are difficult to clean. In contrast, in some disclosed embodiments, at least a portion of or substantially all of the middle portion of the back side of the seat either is connected to or slidably abuts the hinge. Likewise, in some disclosed embodiments, at least a portion of or substantially all of the middle portion of the back side of the lid either is connected to or slidably abuts the hinge.

As mentioned above, some disclosed embodiments are configured to reduce or eliminate gaps between the middle portion of the back side of the seat and the hinge as the seat or lid is moved between the closed position and the open position. These and other embodiments also can be configured to reduce or eliminate gaps between the middle portion of the back side of the lid and the hinge as the seat or lid is moved between the closed position and the open position. For example, in embodiments in which the seat is attached to a first rotatable element, the lid is attached to a second rotatable element, and the first and second rotatable elements rotate on substantially the same axis, an unconnected part of the middle portion of the back side of the seat can be configured to slidably abut the second rotatable element and an unconnected part of the middle portion of the back side of the lid can be configured to slidably abut the first rotatable element. In this way, the seat and lid can be opened and closed without creating any substantial gaps.

The elements of certain embodiments of the disclosed toilet seat hinge can be positioned to substantially abut adjacent elements, such as adjacent fixed elements or adjacent movable elements. For example, a rotatable element, when present, can be configured to substantially abut an adjacent rotatable element, an adjacent tower, or an adjacent cradle. Likewise, a base, when present, can be configured to substantially abut the mounting surface. The space, if any, between substantially abutting elements can be any space small enough to eliminate gaps that are difficult to clean. This can be a space, for example, less than about 2 millimeters, such as less than about 1 millimeter or less than about 0.5 millimeter. Likewise, the gaps referred to elsewhere in this disclosure can be, for example, gaps with widths less than about 2 millimeters, such as less than about 1 millimeter or less than about 0.5 millimeter.

Reducing or Eliminating Sharp Corners

Some embodiments of the disclosed toilet seat assembly are designed to reduce or eliminate sharp corners found in and around conventional toilet seat hinges. Sharp corners can be created where a first surface at a first angle meets a second surface a second angle. A sharp corner can be any corner that is difficult to clean, such as a corner of substantial size that defines a sharp angle. A sharp angle can be, for example, an angle between about 1° and about 110°, such as between about 1° and about 100°, or between about 1° and about 95°. The angle of a curved surface is defined by the average angle of the portion of the surface closest to the meeting point, such as the closest 10 millimeters, 8 millimeters, or 6 millimeters of the surface, excluding small edges. Where a surface extends toward another surface at a first angle and terminates in an edge smaller than about 8 millimeters or, more typically, smaller than about 6 millimeters, smaller than about 4 millimeters, or smaller than about 2 millimeters, the angle of the surface is not defined by the angle of the edge.

Sharp corners can be reduced or eliminated in several ways. For example, in some disclosed embodiments, sharp corners are replaced with curved corners that are concave. In comparison to sharp corners, curved corners that are concave are much easier to clean. Aligning components and preventing them from separating or becoming skewed when the seat or lid is moved can reduce or eliminate additional sharp corners.

In some disclosed embodiments, a first rotatable element is attached to a seat and a second rotatable element is attached to a lid. The hinge of these embodiments can be configured so that the first and second rotatable elements rotate on substantially the same axis, which can be straight or curved. This helps to align the moving parts and to reduce or eliminate sharp corners. For example, in some disclosed embodiments, there are substantially no sharp corners between the first rotatable element and the second rotatable element as the seat or lid is moved between the closed position and the open position. Some disclosed embodiments also have substantially no sharp corners between the rotatable elements and the fixed elements, such as the base, as the seat or lid is moved between the closed position and the open position. Some sharp corners can be reduced or eliminated, for example, by cradling the rotatable elements in the top portion of the base. In some disclosed embodiments, the base covers about the bottom quarter to about the bottom half of the rotatable elements, such as about the bottom third to about the bottom half of the rotatable elements.

In embodiments including first and second rotatable elements, the first and second rotatable elements can have various exposed surfaces when the seat and lid are in different positions. For example, when the seat and lid are in the closed position, the first and second rotatable elements can have exposed back surfaces. When the seat is in the closed position and the lid is in the open position, the first and second rotatable elements can have exposed middle surfaces. When the seat and lid are in the open position, the first and second rotatable elements can have exposed front surfaces. In some disclosed embodiments, the first and second rotatable elements rotate independently without creating any sharp corners. For example, the various exposed surfaces of the first and second rotatable elements can be substantially flush with adjacent exposed surfaces as the seat or lid is moved between the closed position and the open position.

Some hinges of embodiments of the disclosed toilet seat assembly have front, back, and side surfaces. When installed on a standard toilet body, the front surface is the surface that faces the bowl, the back surface is the surface that faces the tank, and the side surfaces are the surfaces that are parallel with the sides of the toilet body. In some disclosed embodiments, the front surface of the hinge abuts the mounting surface at a front surface junction and has a flared bottom portion adjacent to the front surface junction. The back and side surfaces also can have flared bottom portions adjacent to back and side surface junctions, respectively. The flared bottom portions of the front, back, or side surfaces can be configured to substantially abut the mounting surface without creating sharp corners along at least a portion of the front, back, or side surface junctions, respectively. The portion along the front, back, or side surface junction without sharp corners can be, for example, the entire length of the front, back, or side surface junction or the majority of the length of the front, back, or side surface junction. Sharp corners can be reduced or eliminated, for example, by tapering the flared bottom portions so as to make the front, back, or side surfaces at least partially concave.

The first and second rotatable elements (when present) typically have a substantially rounded cross section. In contrast, the seat and lid (when present) typically have a substantially flat cross section. In conventional toilet seat assemblies, sharp corners can be created between the rotatable elements and the seat and lid. In contrast, some disclosed embodiments are designed to reduce or eliminate these sharp corners. The seat can include a seat attachment portion that attaches to a rotatable element at a seat attachment area. Similarly, the lid can include a lid attachment portion that attaches to a rotatable element at a lid attachment area. Each attachment portion can have a top surface and a bottom surface. In some disclosed embodiments, there are substantially no sharp corners along at least a portion of the top or bottom surfaces of the seat or lid attachment portion where they meet the rotatable elements. These sharp corners can be reduced or eliminated, for example, by making the top or bottom surfaces of the attachment portions substantially or at least partially concave. In some disclosed embodiments, at least two of the top surface of the seat attachment portion, the bottom surface of the seat attachment portion, the top surface of the lid attachment portion, and the bottom surface of the lid attachment portion are substantially or at least partially concave.

Mounting on a Toilet Body

Embodiments of the disclosed toilet seat assembly typically are designed to be mounted on toilet bodies, such as standard toilet bodies or non-standard toilet bodies. Some disclosed embodiments have bolt holes for this purpose. Since the bolts are stationary, the bolt holes typically are positioned so that the bolts do not interfere with any movable elements. The bolt holes, for example, can be positioned in fixed elements. In some disclosed embodiments, the bolt holes are positioned below the first and second rotatable elements in the cradle formed by the base. In other embodiments, the bolt holes are positioned in towers. For example, some disclosed embodiments include a first tower with a first bolt hole positioned over a first mounting hole and a second tower with a second bolt hole positioned above a second mounting hole. For mounting on a standard toilet body, the bolt holes can be separated by the standard distance separating the mounting holes, such as a distance of approximately 14 centimeters (5.5 inches).

The bolts used to attach a toilet seat assembly to a toilet body typically have bolt heads. Some disclosed embodiments are configured to reduce or eliminate sharp corners around the bolt heads. This can be done, for example, by making the top surface of the bolt heads flush with, or recessed relative to, the surface of the hinge. Alternatively, the bolt heads can be positioned above the surface of the hinge but rounded or otherwise contained within rounded bulges. In some disclosed embodiments, the bolt heads are positioned within openings that are recessed relative to the surface of the hinge so as to provide room for the bolt heads to be positioned below the surface of the hinge. The openings also can be covered with bolt hole covers. These bolt hole covers can be flush with the surrounding surface or slightly bulged or recessed with respect to the surrounding surface. In some disclosed embodiments, when the toilet seat assembly needs to be removed, the bolt hole covers can be snapped out of the openings.

To create surfaces with a high degree of continuity, some disclosed embodiments do not include exposed access openings for accessing the bolts. These embodiments can be configured, for example, to receive the bolts through a bottom surface that is adjacent to the mounting surface when the hinges are installed on a toilet body. The bolts can be manipulated from below the mounting surface. For example, some disclosed embodiments are configured to receive the bolt heads through the bottom surface and to allow the bolt heads to be shifted so that they catch on a lip. The bolts then can be tightened with a nut below the mounting surface. Alternatively, disclosed embodiments can be configured to receive the shaft of the bolts, such as within a threaded opening. These and other embodiments can be attached to a toilet body using bolts with or without bolt heads. In either case, an adjustable nut can be positioned below the mounting surface to hold the hinge in place.

Construction

The hinges of embodiments of the disclosed toilet seat assembly can be manufactured alone or with a seat or with both a seat and a lid. The hinges can be designed to be compatible with conventional manufacturing processes. Conventional toilet seat assemblies often are made of molded materials. The hinges of embodiments of the disclosed toilet seat assembly can be manufactured, for example, as several molded pieces that fit together. Some embodiments of the disclosed toilet seat assembly, for example, can be manufactured as a first piece including a base, a second piece including a seat and a first rotatable element, and a third piece including a lid and a second rotatable element. The first, second, and third pieces, can be assembled alone or with other components to form the overall toilet seat assembly.

Injection molding is one example of a method for making the components of certain disclosed embodiments. When making these components using molding processes, it often is difficult to form narrow elements and sharp points. In some disclosed embodiments, the elements with these features can be modified to be more compatible with molding processes. For example, as seen in the exemplary embodiment illustrated in FIGS. 2A-2C, the front flared bottom portion 40 of the illustrated embodiment has a small edge adjacent to the front surface junction 64. Similarly, the back flared bottom portion 42 of the illustrated embodiment has a small edge adjacent to the back surface junction 66. Small edges also can be found in some disclosed embodiments on the top and bottom surfaces of the seat and lid attachment portions, for example, where they slidably abut separate elements, such as towers and separate rotatable elements. Examples of this type of small edge also can be seen in FIGS. 2A-2C. By incorporating small edges instead of sharp points, components of some embodiments of the toilet seat assembly can be manufactured more easily with molding processes. In comparison to components that end in sharp points, components that end in small edges also have increased strength and an increased tendency to hold their shape over time. The small edges can have various sizes. As discussed above, small edges generally are not considered when calculating the angle of the surface ending in the small edge.

In some disclosed embodiments, the number of small edges and the size of the small edges are minimized as much as possible. Some disclosed embodiments, particularly embodiments constructed of very hard materials, have edges smaller than about 3 millimeters, such as smaller than about 2 millimeters or smaller than about 1 millimeter. Embodiments of the disclosed toilet seat assembly also can include components that end in sharp points with substantially no small edges. Certain modern injection molding techniques known to persons of ordinary skill in the art are capable of forming high quality components to tight manufacturing tolerances. In embodiments that include a conformable pad adjacent to the mounting surface, the conformable pad can have edges cut at angles such that the bottom portions of the conformable pad extend outward farther than the top portions. This can help to minimize interruption of the curvature of the front, back, and/or side surfaces of hinges of embodiments of the disclosed toilet seat assembly as they approach the mounting surface.

Hinges of embodiments of the disclosed toilet seat assembly can be made of a variety of materials, including plastic, which currently is used to make most conventional toilet seat hinges. In some disclosed embodiments, the hinge is made of materials that are harder than conventional materials used to make toilet seat hinges. The back portions of the seat and lid also can be made of such materials. For example, some disclosed embodiments include hinges and back portions of the seat and lid that are made of materials harder than polypropylene. Components made of harder materials often can be manufactured to more exacting tolerances. The finished components also typically are better able to fit tightly against each other and to form narrow shapes without deforming over time. Examples of suitable materials include metal, ceramic, glass, and hard plastics and resins, such as epoxy resins, acrylics, and polycarbonates.

In some disclosed embodiments, different portions are made of different materials. For example, in embodiments in which bolts are received by threaded channels, the threaded channels can be made of metal and embedded in another material, such as epoxy resin. Similarly, in embodiments that include an axle, the axle can be made of metal, while other components are made of one or more different materials. In some disclosed embodiments, main portions of the seat and/or lid are made of materials with lower density than the materials used to make the hinge and back portions of the seat and/or lid. For example, the main portions of the seat and/or lid can be made of wood or plastic.

Injection molding processes allow objects to be formed with or without substantial voids. Voids can be used to reduce the cost of materials and reduce the weight of the molded object. Embodiments of the disclosed toilet seat assembly can be formed with or without substantial voids. Certain materials make it possible to achieve acceptable quality in components that are at least partially hollow.

Some embodiments of the disclosed toilet seat assembly have a substantially consistent cross section throughout the hinge and back portion of the seat or throughout the hinge and back portions of the seat and lid. Extrusion, therefore, can be useful to form these sections as an alternative to injection molding. In one example, the hinge and back portion of the seat or the hinge and back portions of the seat and lid are extruded as a single piece and then cut and joined to form the necessary interfaces. Alternatively, different portions of the hinge and back portion of the seat or the hinge and back portions of the seat and lid can be extruded separately. Separate elements can be joined, for example, with epoxy or mechanical fasteners. Biscuit or mortise and tenon joinery can be used to add additional strength. For example, in some disclosed embodiments, main portions of the seat and/or lid are joined to back portions using biscuit or mortise and tenon joinery.

Some disclosed embodiments include components that slide against other components. To keep these tight-fitting components moving smoothly, they can be made of or coated with materials that that tend to slide easily. For example, components of disclosed embodiments can be made of or coated with materials (e.g., polytetrafluoroethylene) having low coefficients of friction. Such materials can serve to reduce friction when components made of or coated in the materials rub against adjacent components. Alternatively, some friction may be desirable to prevent the seat and lid from slamming.

Additional Features

To reduce or eliminate sharp corners, some disclosed embodiments are configured so that the seat and lid are attached well above the mounting surface of the toilet body. There also can be a height difference between the seat and the lid near the hinge. To support sufficient weight, portions of the seat typically rest on the surface of the edge of the bowl when the seat is closed. Similarly, portions of the lid typically rest on the seat when the lid is closed. Thus, some disclosed embodiments are designed to span the vertical spaces between the toilet body, the seat and the lid. This can be done, for example, by giving the seat or lid a downward slope as it extends away from the hinge area. In another example, risers span the height differences. With respect to the seat, these risers can be any elements that span the space between the seat and the surface of the edge of the bowl when the seat is closed. For example, the risers can be oblong shaped protrusions positioned on the bottom of the seat. The lid also can include risers to span the space between the lid and the seat when the lid and seat are closed. The risers below the lid typically do not need to be as strong as the risers below the seat because the lid typically does not need to support large amounts of weight.

As disclosed above, in some disclosed embodiments, the base is configured to cover a portion of the mounting surface. Typical toilet bodies are made of ceramic and the mounting surfaces can be uneven. To more effectively cover uneven mounting surfaces, some disclosed embodiments include a conformable pad configured to be positioned between the hinge and the mounting surface when the hinge is installed on a toilet body. This conformable pad can conform to the bottom surface of the hinge and the mounting surface and help to reduce or eliminate gaps between the two surfaces. In some disclosed embodiments, the conformable pad also increases the friction between the hinge and the mounting surface so that the toilet seat assembly remains stationary on the mounting surface. The conformable pad can be made of any conformable material, such as natural or synthetic rubber. The conformable pad typically has a footprint on the mounting surface matching the footprint of the hinge. Alternatively, the conformable pad can have a footprint smaller or larger than the footprint of the hinge.

Some disclosed embodiments include conformable pads positioned at other junctions, such as between and around various moving components. Conformable pads can help to minimize gaps at these junctions by conforming to the surfaces being joined. For example, conformable pads, such as disks, can be positioned between adjacent rotatable elements. Suitable conformable materials for use adjacent to moving elements include soft plastics.

The tight-fitting movable components in some disclosed embodiments can be configured to move with varying amounts of resistance. This resistance can be modified, for example, by modifying the force holding the components together. In some disclosed embodiments, there is sufficient friction within and/or around the hinge (e.g., between a first rotatable element and adjacent elements) to hold the seat in place at substantially any point between the closed position and the open position. Similarly, the friction within and/or around the hinge (e.g., between a second rotatable element and adjacent elements) can be enough to hold the lid in place at substantially any point between the closed position and the open position. This is helpful to prevent the seat and lid from slamming against each other or the toilet body.

Additional Embodiments

In addition to the disclosed embodiments, many other embodiments will be apparent to those of ordinary skill in the art from a consideration of this specification, or practice of the invention disclosed herein. It is intended that the specification be considered as exemplary only, with the true scope and spirit of the invention being indicated by the following claims.

I claim:

1. A toilet seat assembly, comprising:

a seat;

a lid; and a hinge including one or more fixed elements and two or more rotatable elements, wherein the hinge allows the independent movement of the seat and the lid between a closed position and an open position, the seat either is connected to or slidably abuts the hinge along substantially the entire length of a portion of the hinge extending between a first mounting hole and a second mounting hole on a mounting surface of a toilet body when the toilet seat assembly is mounted on the toilet body, the lid either is connected to or slidably abuts the hinge along substantially the entire length of the portion of the hinge extending between the first mounting hole and the second mounting hole on the mounting surface of the toilet body when the toilet seat assembly is mounted on the toilet body, there are substantially no exposed gaps between the hinge and the mounting surface of the toilet body between the first mounting hole and the second mounting hole when the toilet seat assembly is mounted on the toilet body, and the hinge covers a continuous path between the first mounting hole and the second mounting hole on the mounting surface of the toilet body when the toilet seat assembly is mounted on the toilet body.

2. A toilet seat assembly, comprising:

a seat;

a lid; and a hinge including a first rotatable element attached to the seat and a second rotatable element attached to the lid, wherein the hinge covers a continuous path between a first mounting hole and a second mounting hole on a mounting surface of a toilet body when the toilet seat assembly is mounted on the toilet body, the first and second rotatable elements rotate on substantially the same axis, the seat slidably abuts the second rotatable element, the lid slidably abuts the first rotatable element, there are substantially no exposed gaps between the first rotatable element and the mounting surface of the toilet body when the toilet seat assembly is mounted on the toilet body, and there are substantially no exposed gaps between the second rotatable element and the mounting surface of the toilet body when the toilet seat assembly is mounted on the toilet body.

3. A toilet seat assembly, comprising:

a seat;

a lid; and a hinge, wherein the hinge allows the independent movement of the seat and the lid between a closed position and an open position, a top surface of the seat adjacent to the hinge and a surface of the hinge together form a first elongated, substantially concave surface, a bottom surface of the lid adjacent to the hinge and a surface of the hinge together form a second elongated, substantially concave surface, the first elongated, substantially concave surface and the second elongated, substantially concave surface are bisected by an axis of symmetry of a toilet body when the toilet seat assembly is mounted on the toilet body, there are substantially no exposed gaps between the seat and the hinge along the first elongated, substantially concave surface as the seat is moved between the closed position and the open position, and there are substantially no exposed gaps between the lid and the hinge along the second elongated, substantially concave surface as the lid is moved between the closed position and the open position.

4. The toilet seat assembly according to claim 3, wherein the hinge, the first elongated, substantially concave surface, and the second elongated, substantially concave surface each have a length substantially parallel to a pivot axis of the seat and a pivot axis of the lid, the length of the first elongated, substantially concave surface is equal to or greater than about one third of the length of the hinge, and the length of the second elongated, substantially concave surface is equal to or greater than about one third of the length of the hinge.

5. The toilet seat assembly according to claim 4, wherein there are substantially no exposed gaps between the hinge and a mounting surface of the toilet body along the length of the first elongated, substantially concave surface or the length of the second elongated, substantially concave surface when the toilet seat assembly is mounted on the toilet body, and the hinge covers a continuous path between a first mounting hole and a second mounting hole on the mounting surface of the toilet body when the toilet seat assembly is mounted on the toilet body.

6. A toilet seat assembly, comprising:

a seat; and a hinge including a rotatable element and a fixed tower, wherein the rotatable element is positioned horizontally to the side of the fixed tower when the toilet seat assembly is mounted on a toilet body, the rotatable element is attached to the seat, the seat slidably abuts a convex surface of the fixed tower, the hinge covers a continuous path between a first mounting hole and a second mounting hole on a mounting surface of a toilet body when the toilet seat assembly is mounted on the toilet body, there are substantially no exposed gaps between the hinge and the mounting surface of the toilet body between the first mounting hole and the second mounting hole when the toilet seat assembly is mounted on the toilet body, and there are substantially no exposed gaps between the rotatable element and the fixed tower as the seat is moved between a closed position and an open position.

7. The toilet seat assembly according to claim 6, wherein there are substantially no exposed gaps between the rotatable element and the mounting surface of the toilet body when the toilet seat assembly is mounted on the toilet body.

8. The toilet seat assembly according to claim 6, wherein exposed surfaces of the rotatable element and the fixed tower are substantially flush along substantially an entire seam between the rotatable element and the fixed tower as the seat is moved between the closed position and the open position so as not to create any sharp corners between the rotatable element and the fixed tower as the seat is moved between the closed position and the open position.

9. The toilet seat assembly according to claim 6, wherein the rotatable element is a first rotatable element, the hinge includes a second rotatable element, the toilet seat assembly further comprises a lid, the second rotatable element is attached to the lid, and the lid slidably abuts a convex surface of the fixed tower.

10. The toilet seat assembly according to claim 9, wherein the seat slidably abuts a convex surface of the second rotatable element, and the lid slidably abuts a convex surface of the first rotatable element.

11. The toilet seat assembly according to claim 9, wherein there are substantially no exposed gaps between the first rotatable element and the mounting surface of the toilet body when the toilet seat assembly is mounted on the toilet body, and there are substantially no exposed gaps between the second rotatable element and the mounting surface of the toilet body when the toilet seat assembly is mounted on the toilet body.

12. The toilet seat assembly according to claim 9, wherein a top surface of the seat adjacent to the hinge and a bottom surface of the lid adjacent to the hinge or the top surface of the seat adjacent to the hinge, the bottom surface of the lid adjacent to the hinge, and a surface of the hinge together form an elongated, substantially concave surface when the seat and the lid are in the closed position, and the elongated, substantially concave surface is bisected by an axis of symmetry of the toilet body when the toilet seat assembly is mounted on the toilet body.

13. The toilet seat assembly according to claim 6, wherein the rotatable element is attached to a seat attachment portion of the seat, the seat attachment portion of the seat has a top surface and a bottom surface, and the top surface of the seat attachment portion and the bottom surface of the seat attachment portion are substantially concave.

14. A toilet seat assembly, comprising:

a seat; and a hinge including a rotatable element and a fixed cradle, wherein the fixed cradle is positioned vertically below the rotatable element when the toilet seat assembly is mounted on a toilet body, the rotatable element is attached to the seat, the cradle slidably abuts a convex surface of the rotatable element, the hinge covers a continuous path between a first mounting hole and a second mounting hole on a mounting surface of a toilet body when the toilet seat assembly is mounted on the toilet body, there are substantially no exposed gaps between the hinge and the mounting surface of the toilet body between the first mounting hole and the second mounting hole when the toilet seat assembly is mounted on the toilet body, and there are substantially no exposed gaps between the rotatable element and the mounting surface of the toilet body when the toilet seat assembly is mounted on the toilet body.

15. The toilet seat assembly according to claim 14, wherein exposed surfaces of the rotatable element and the fixed cradle are substantially flush along substantially an entire seam between the rotatable element and the fixed cradle as the seat is moved between the closed position and the open position so as not to create any sharp corners between the rotatable element and the fixed cradle as the seat is moved between the closed position and the open position.

16. The toilet seat assembly according to claim 14, wherein the rotatable element is a first rotatable element, the hinge includes a second rotatable element, the toilet seat assembly further comprises a lid, the second rotatable element is attached to the lid, and the cradle slidably abuts a convex surface of the second rotatable element.

17. The toilet seat assembly according to claim 16, wherein the seat slidably abuts a convex surface of the second rotatable element, and the lid slidably abuts a convex surface of the first rotatable element.

18. The toilet seat assembly according to claim 16, wherein there are substantially no exposed gaps between the second rotatable element and the mounting surface of the toilet body when the toilet seat assembly is mounted on the toilet body.

19. The toilet seat assembly according to claim 16, wherein a top surface of the seat adjacent to the hinge and a bottom surface of the lid adjacent to the hinge or the top surface of the seat adjacent to the hinge, the bottom surface of the lid adjacent to the hinge, and a surface of the hinge together form an elongated, substantially concave surface when the seat and the lid are in the closed position, and the elongated, substantially concave surface is bisected by an axis of symmetry of the toilet body when the toilet seat assembly is mounted on the toilet body.

20. The toilet seat assembly according to claim 14, wherein the rotatable element is attached to a seat attachment portion of the seat, the seat attachment portion of the seat has a top surface and a bottom surface, and the top surface of the seat attachment portion and the bottom surface of the seat attachment portion are substantially concave.

21. The toilet seat assembly according to claim 14, wherein the cradle covers from about the bottom third to about the bottom half of the rotatable element.

22. A toilet seat assembly, comprising:

a seat; and a hinge including a rotatable element and a fixed element, wherein the rotatable element is attached to the seat, the seat has an elongated surface along which the seat either is connected to or slidably abuts the hinge, the elongated surface of the seat is bisected by an axis of symmetry of a toilet body when the toilet seat assembly is mounted on the toilet body, the hinge covers a continuous path between a first mounting hole and a second mounting hole on a mounting surface of the toilet body when the toilet seat assembly is mounted on the toilet body, there are substantially no exposed gaps between the hinge and the mounting surface of the toilet body between the first mounting hole and the second mounting hole when the toilet seat assembly is mounted on the toilet body, and there are substantially no exposed gaps between the rotatable element and the mounting surface of the toilet body when the toilet seat assembly is mounted on the toilet body.

23. The toilet seat assembly according to claim 22, wherein the rotatable element is a first rotatable element, the hinge includes a second rotatable element, the toilet seat assembly further comprises a lid, the second rotatable element is attached to the lid, the lid has an elongated surface along which the lid either is connected to or slidably abuts the hinge, and the elongated surface of the lid is bisected by the axis of symmetry of the toilet body when the toilet seat assembly is mounted on the toilet body.

* * * * *